US005429182A

United States Patent [19]

Hanafusa

[11] Patent Number: 5,429,182

[45] Date of Patent: Jul. 4, 1995

[54] HEAT EXCHANGER HAVING INLET AND OUTLET PIPES FOR A HEAT EXCHANGING MEDIUM AND A METHOD OF MAKING SAME

[75] Inventor: Tatsuya Hanafusa, Oyamashi, Japan

[73] Assignee: Showa Aluminum Corporation, Japan

[21] Appl. No.: 118,891

[22] Filed: Sep. 8, 1993

[51] Int. Cl.[6] ..... F28F 9/007

[52] U.S. Cl. ..... 165/67; 165/149; 165/178

[58] Field of Search ..... 165/67, 149, 153, 173, 165/178

[56] References Cited

U.S. PATENT DOCUMENTS

| | | | |
|---|---|---|---|
| 3,213,931 | 10/1965 | Hilicki | 165/67 |
| 4,903,389 | 2/1990 | Wolf | 165/153 X |
| 5,205,349 | 4/1993 | Nagao et al. | 165/67 |
| 5,209,290 | 5/1993 | Chigira | 165/149 |
| 5,240,068 | 8/1993 | Tokutake | 165/67 |

*Primary Examiner*—John Rivell
*Assistant Examiner*—L. R. Leo

[57] ABSTRACT

A clamper (12) has a clamp finger (12*a*) for gripping a joint pipe (5), and is preliminarily attached to a preassembly of a heat exchanger. The clamp finger (12*a*) is deformed to embrace the joint pipe (5), before the preassembly is subjected to the so-called one shot brazing process. Thereafter, the joint pipe (5) is brazed to and become integral with the clamp finger (12*a*) which is embracing the joint pipe, at the same time as the essential parts incorporated in the heat exchanger preassembly are brazed one to another. Thus, the clamper (12) not only serves as a supporter for keeping the joint pipe (5) in place after the brazing, but also functions as a jig of such a kind as holding in place the joint pipe (5) in the unbrazed assembly of the heat exchanger, thus improving the manufacture efficiency of heat exchangers.

6 Claims, 19 Drawing Sheets

HEAT EXCHANGER HAVING INLET AND OUTLET PIPES FOR A HEAT EXCHANGING MEDIUM AND A METHOD OF MAKING SAME

BACKGROUND OF THE INVENTION

1. Field of the Invention

The present invention relates to a heat exchanger having an inlet and outlet pipes for a heat exchanging medium flowing through the heat exchanger, and also to a method of making the heat exchanger which is composed of brazeable metal parts, in particular aluminum parts, and adapted for use as a condenser in car cooling systems or for use as an oil cooler or the like.

2. Description of Prior Art

Recently, aluminum heat exchangers of the so-called multi-flow type have been preferred as the condensers in the car cooling systems. This heat exchanger comprises a plurality of tubes each having both ends connected a pair of hollow headers in fluid communication therewith. Joint pipes are secured to the headers so as to provide an inlet passageway and an outlet passageway for the heat exchanging medium. In manufacture of such a heat exchanger, those parts are assembled and then subjected to the one-shot brazing process so that said parts become rigidly integral with one another.

There are some cases wherein the joint pipes must be long enough to extend to given positions, which positions may be determined taking into account a dimensional relationship between the heat exchanger and a space for receiving same, and/or taking into account the shape and/or length of pipings which extend from an automobile body.

When manufacturing the heat exchanger in those cases, its parts are combined at first with one another to form a preliminary assembly. An intermediate portion of each elongate joint pipe has to be set in place by means of a suitable tool or jig. The temporary assembly will then be one-shot brazed to rigidly fix the parts in place and integral with one another, before the assembling tool or jig is removed from the heat exchanger.

Subsequent to this process, each joint pipe or piping has been connected to the heat exchanger body 52 by means of a clamper 51 in a manner as shown in FIG. 29. This clamper protects the joint pipe from torsion, vibration or the like, and comprises a clamp base 53 and a band-shaped clamp finger 54. The clamp base 53 is secured to the heat exchanger body 52, with the clamp finger 54 having a curved portion 54*a* fittable on a piping. A bolt 56 fixes the clamp finger 54 to the clamp base 53 which cooperates with the clamp finger so as to surround the periphery of the joint pipe 55 and hold it in place.

According to the prior art method, the jig is attached to joint pipe 55, then the brazing of the parts is carried out, and subsequently the jig is detached from joint pipe before the clamper 51 is attached thereto. Those intricate steps have rendered inefficient the manufacture of heat exchangers. In addition, each clamper 51 composed of some parts such as the clamp base 53, the clamp finger 54 and the bolt 56 is complicated in structure and consequently somewhat expensive. Further, it requires much labor to attach the clamper to the heat exchanger.

OBJECTS AND SUMMARY OF THE INVENTION

A first object of the present invention is to provide a heat exchanger which has an inlet and outlet pipes for a heat exchanging medium flowing through the heat exchanger, and which can be efficiently manufactured without needing much labor.

A second object of the invention is to provide a method which enables efficient manufacture of a heat exchanger, even if its inlet pipe and/or outlet pipe for a heat exchanging medium are considerably long.

A heat exchanger, which is provided herein from an aspect of the invention, comprises: an inlet and an outlet of a heat exchanging medium; a main body formed with the outlet and the inlet and conducting the exchange of heat between the medium flowing through the main body and an ambient air, with the main body being composed of essential parts; at least one joint pipe connected to the inlet and/or outlet and allowing the medium to flow into or out of the main body; at least one clamper for temporarily holding in place the joint pipe on the main body when a temporary assembly of the essential parts are brazed one to another, with the clamper being constructed such as to fixedly secure the joint pipe to the main body once the essential parts are brazed; and the clamper comprising at least one clamp finger which fits on and hold in place the joint pipe, wherein the clamp finger is brazed to and integral with the joint pipe.

A method of making a heat exchanger comprising at least one joint pipe connected to an inlet or outlet of a heat exchanging medium is provided herein from another aspect of the invention, the method comprising the steps of: preparing at least one clamper which comprises at least one clamp finger; preliminarily assembling essential parts of the heat exchanger to form a preassembly; then connecting the joint pipe to the preassembly in fluid communication therewith; setting in place the clamper directly on the preassembly or on any accessory such as a side frame or a clampable piece attached to the temporary assembly; causing the clamp finger to hold the joint pipe; and subsequently brazing the essential parts one to another and brazing at the same time the clamp finger to the joint pipe.

The clamper used in this method not only serves to keep in place the inlet or outlet joint pipe for the heat exchanging medium in the brazed heat exchanger, but also serves as a support which retains the joint pipe in correct position on the unbrazed preassembly of the essential parts. Hence, any jig need no longer be attached to the joint pipe before the brazing process and be detached therefrom after this process, in order that the clamper takes the place of the jig. Since these intricate steps unavoidable in the prior art method are now dispensed with, the heat exchangers can be manufactured more efficiently in accordance with the present invention.

Each clamper comprises the brazeable clamp finger and thus can be fastened without use of any bolt. Such a simplified structure is an advantageous feature from an economical point of view. Further, the clamp finger is brazed to the pipe joint before the operations to manufacture the heat exchanger are finished. Therefore, the adjoining strength of the finger brazed to the joint is higher and more durable than ever.

Other objects and advantages of the invention will become apparent from the preferred embodiments which are described hereinafter. The embodiments however do not delimit the present invention, but any modification can be made within its scope and spirit.

BRIEF DESCRIPTION OF THE DRAWINGS

FIGS. 1 to 7 show a heat exchanger in a first embodiment, in which:

FIG. 1 is a front elevation showing the heat exchanger in its entirety;

FIG. 2 is a plan view of the heat exchanger, taken in its entirety;

FIG. 3 is a side elevation of the heat exchanger, taken in its entirety;

FIG. 4 is a plan view of a clamper for use with a joint pipe connected to an inlet;

FIG. 5 is a side elevation a further clamper for use with another joint pipe connected to an outlet;

FIG. 6 is a perspective view of a side frame; and

FIGS. 8 to 12 show a heat exchanger in a second embodiment, in which:

FIG. 8 is a perspective view showing partly in section a joint pipe which is secured to a heat exchanger body by means of a clamper, with the joint pipe being connected to an inlet for a heat exchanging medium;

FIG. 9 is a cross section taken along the line 9—9 in FIG. 8;

FIG. 10 is a perspective view showing the joint pipe, the heat exchanger body and the clamper, in their disassembled state;

FIG. 11 is a front elevation of the heat exchanger, taken in its entirety; and FIG. 12 is a plan view of the heat exchanger;

FIGS. 13 to 15 show a heat exchanger in a third embodiment, in which:

FIG. 13 is a perspective view showing partly in section a joint pipe which is secured to a heat exchanger body by means of a clamper;

FIG. 14 is a plan view of the clamper and a portion of the heat exchanger to which the clamper is attached, with some members being shown in cross section; and FIG. 15 is front elevation of the clamper and the portion of the heat exchanger;

FIGS. 16 and 17 show a heat exchanger in a fourth embodiment, in which:

FIG. 16 is a perspective view showing partly in section and in disassembled state a joint pipe which is secured to a heat exchanger body by means of a clamper, with the joint pipe being connected to an inlet for a heat exchanging medium; and FIG. 17 is a horizontal cross section of the members shown in FIG. 16, but in their assembled state;

FIGS. 18 to 28 show a heat exchanger in a fifth embodiment, in which:

FIG. 18 is a perspective view of a clamper composed of a first and second segments, shown in their disassembled state;

FIG. 19 is a perspective view of the clamper composed of the first and second segments, shown in their assembled state;

FIGS. 22 to 24 illustrate a process of combining the first segment with the second segment of the clamper;

FIG. 25 is a perspective view of a pipe-and-clamper unit shown in its state separated from the assembled heat exchanger body, wherein the unit comprises the joint pipe held in place by the clamper;

FIG. 26 is a perspective view of the pipe-and-clamper unit shown in its state secured to the assembled heat exchanger body;

FIG. 27 is a front elevation of the heat exchanger shown in its entirety; and FIG. 28 is a plan view of the heat exchanger shown in its entirety.

DETAILED DESCRIPTION OF THE PREFERRED EMBODIMENTS

Now the present invention will be described in detail referring to some embodiments in which heat exchangers of the multi-flow type for use as a condenser in car air conditioners are provided.

It is noted at first that the present invention is applicable also to other various types of heat exchangers such as an evaporator, oil cooler and a radiator. All of these heat exchangers are of the multi-flow type, and the evaporator may be employed in the car air conditioners or room air conditioners. Each heat exchanger of this type comprises a pair of headers spaced a given distance from one another, a plurality of flat tubes each having its both ends connected to the headers in fluid communication therewith, and fins each interposed between the adjacent tubes.

The invention is also applicable to the heat exchangers of the so-called serpentine type in which an elongate flat tube is repeatedly bent in a meandering manner. A plurality of spaces each defined between tube portions lying in parallel with one another are provided, and fins are disposed in the spaces. In any case, the present invention may be applied most advantageously to a heat exchanger whose joint pipes for flowing a heat exchanging medium do extend a long distance outwardly from an inlet and outlet for the medium.

First Embodiment

Figure 1:
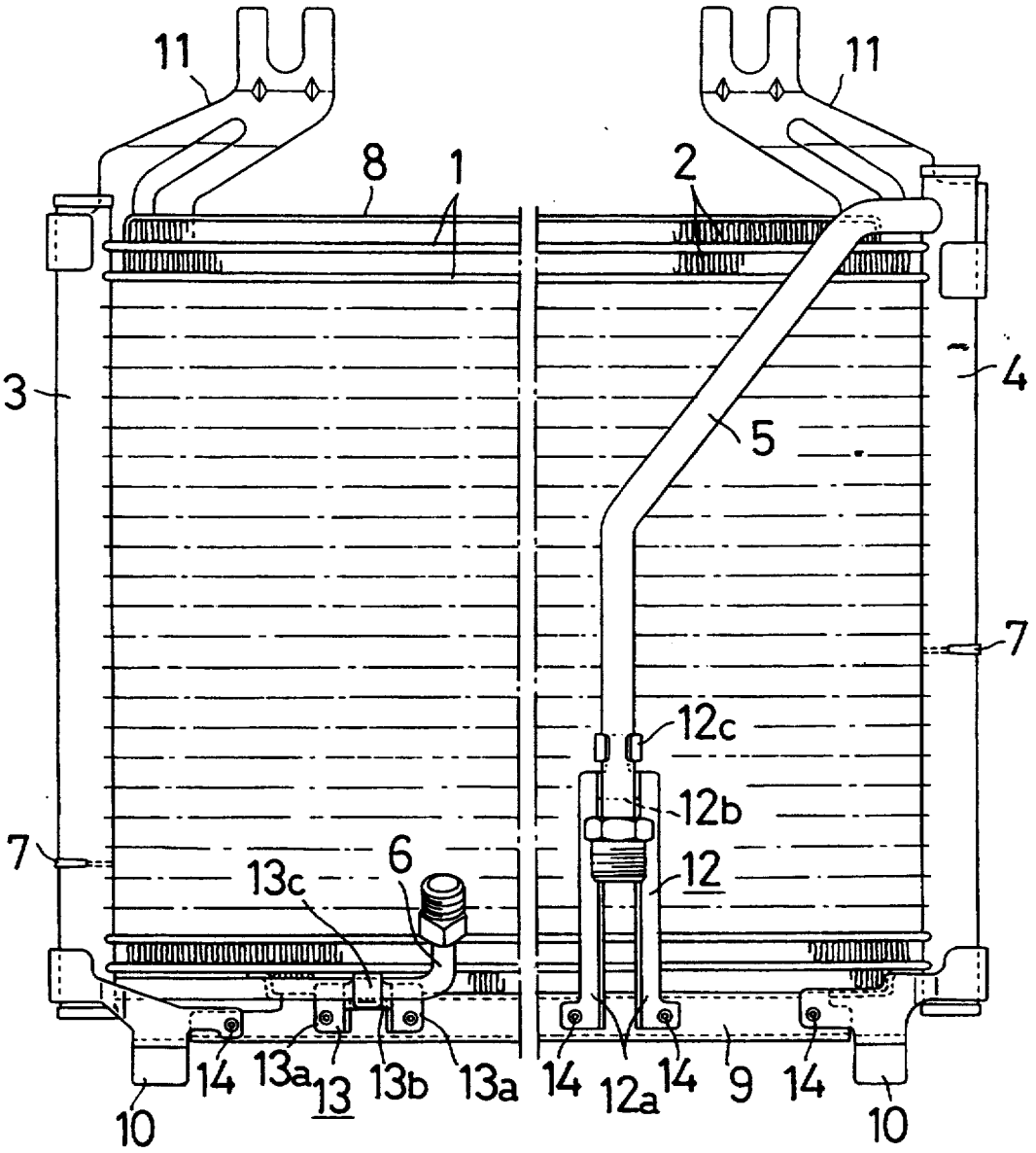
Figure 2:
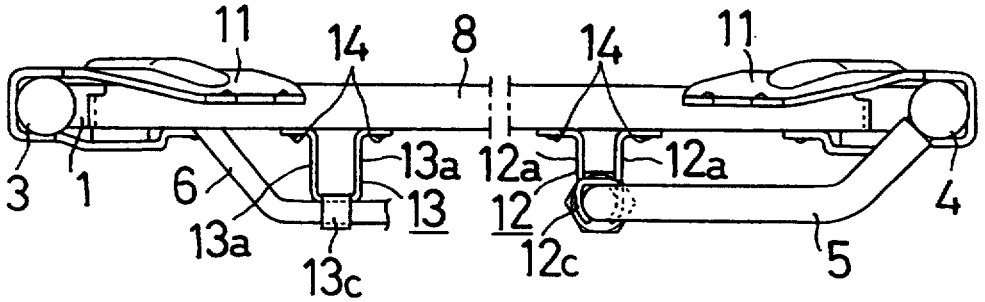
Figure 3:
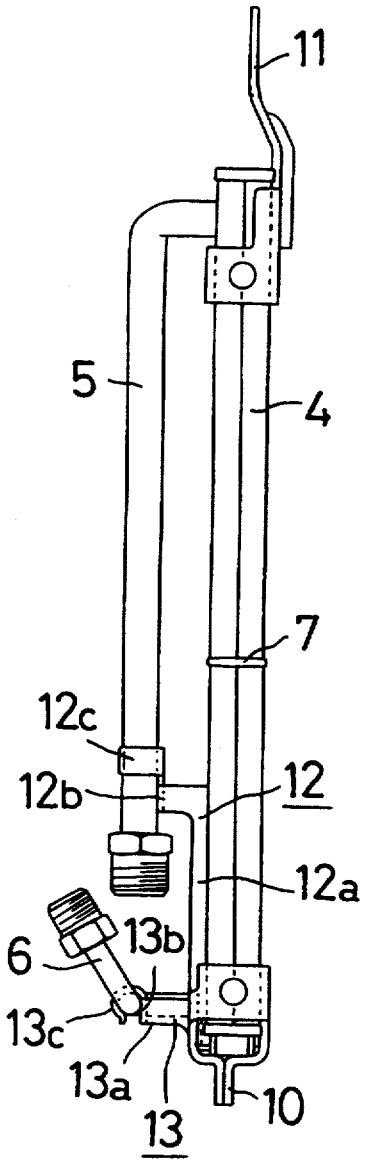

FIGS. 1 to 3 illustrate a completely manufactured heat exchanger, in its entirety, wherein the reference numerals 1 and 2 respectively denote flat tubes and corrugated fins which extend horizontally to be stacked one on another.

Both ends of each flat tube 1 are connected to a left-hand and right-hand hollow headers 3 and 4, in fluid communication therewith.

A joint pipe 5 extends from a heat exchanging medium inlet formed at an upper side surface of the right-hand header 4. A further joint pipe 6 extends from a heat exchanging medium outlet formed at a lower side surface of the left-hand header 3.

Each of partitions 7 divides the interior of the header 3 or 4 at its given height so that the heat exchanging medium meanders through groups of the tubes 1. An upper side plate 8 is disposed outside the uppermost corrugated fin 2 so as to protect it.

The reference numeral 9 denotes a lower side frame which is disposed outside the lowermost corrugated fin 2, and brackets and other accessories are secured to the side frame 9 protecting this fin 2. Lower brackets 10 which are made from an aluminum brazing sheet serve to secure a lower end of this heat exchanger to an automobile body, while upper brackets 11 also made of the sheet serve to secure an upper end of heat exchanger to the automobile body.

A clamper 12 clamps an intermediate portion of the joint pipe 5 extending from the inlet, while a further clamp 13 clamps an intermediate portion of the other joint pipe 6 extending from the outlet, so that both the pipes 5 and 6 are kept in place.

Details of the principal members are as follows.

The flat tubes 1 are aluminum extruded profiles of the so-called harmonica type, which comprises an upper and lower walls facing one another, though not shown in the drawings. Internal partitioning walls extend longitudinally of each tube 1 so as to divide the interior thereof into some paths for a coolant. Heat conductivity and pressure resistance of the tubes are improved by the existence of such partitioning walls. Alternatively, seam-welded pipes each having inner fins may be used in place of the extruded profiles.

The fins 2 are made of a band-shaped sheet of substantially the same width as each tube 1, wherein the sheet is corrugated and louvers not shown are opened up. The band-shaped sheet may be an aluminum brazing sheet which is composed of a core having both sides clad with a brazing agent layer.

Each of the headers 3 and 4 is made from another aluminum brazing sheet having either or both sides clad with the brazing agent layer. This sheet is bent to assume a shape of cylindrical pipe such that its lateral edges abut against, and are brazed to, each other. Aluminum caps each having a short cylindrical flare are fitted on and similarly brazed to open ends of the pipe. Alternatively, the abutting edges may be seam-welded.

The joint pipe 5 from the inlet and the other joint pipe 6 from the outlet are aluminum pipes.

The right-hand header 4 has at its upper side portion a not shown aperture which receives an upper end of the joint pipe 5 liquid tightly and in fluid communication. This joint pipe 5 extends oblique and downwards from its upper end inwardly of the heat exchanger, and is bent at its intermediate portion to form a vertically pendent lower portion.

The left-hand header 3 has at its lower side portion a not shown aperture which receives a left end of the further joint pipe 6 liquid tightly and in fluid communication. This further joint pipe 6 extends straight and rightwards from its left end inwardly of the heat exchanger, and is bent at a portion near its right end to form an upright portion.

Figure 4:
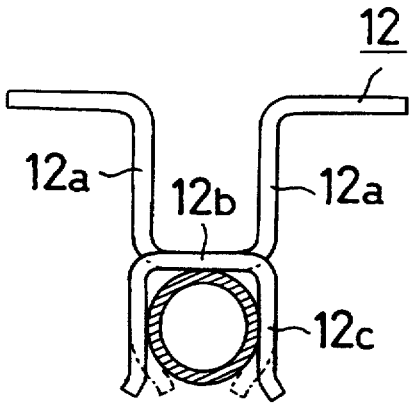
Figure 5:
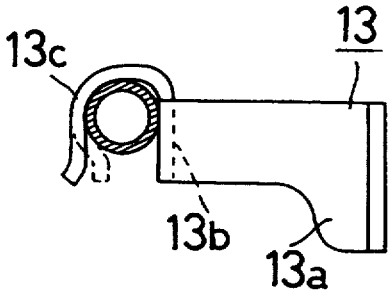
Figure 6:
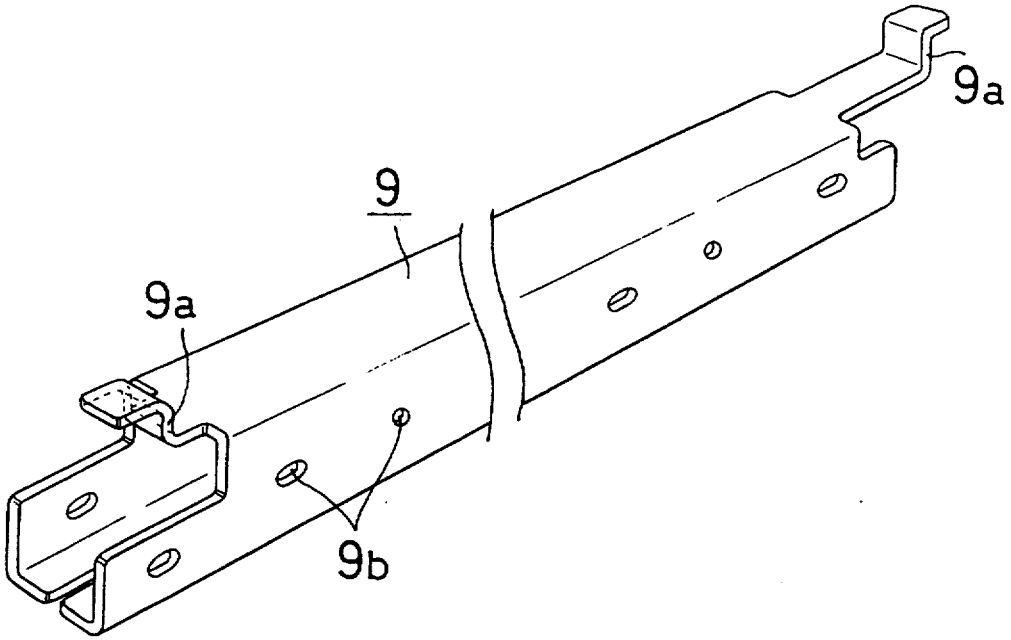
Figures 7A, 7B, 7C, 7D:
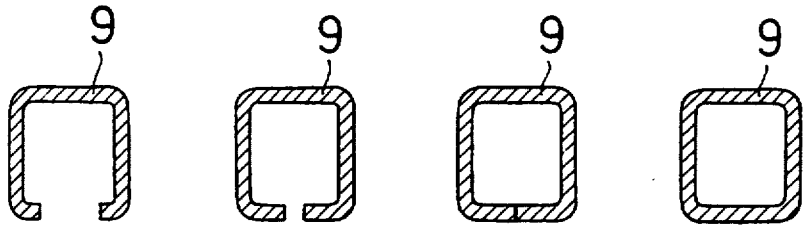
FIGS. 7A to 7D are transversal cross sections of an intermediate portion of the side frame.

The lower side frame 9 is an aluminum cylinder which is square in cross section as shown in FIG. 6. This cylinder, which may be extruded or made by the pressing technique or the like, has at its ends upwardly bent shoulders 9*a* for supporting side ends of the lowermost fin 2. A row of some apertures 9*b* are formed through each of vertical walls of the side frame 9. The apertures receive rivets for attachment of accessories. Cross-sectional shape of the side frame 9 may be any of those which are shown in FIGS. 7A to 7D. In other words, the side frame may have a longitudinal opening through its bottom as illustrated in FIGS. 7A and 7B, or may be a solid rectangular loop in cross section as illustrated in FIGS. 7C and 7D. The clamper 12 for supporting the joint pipe 5 connected to the heat exchanging medium inlet comprises a pair of left and right fixable feet 12*a*, a tie bar 12*b* and clamp fingers 2*c*, as shown in FIGS. 1 to 3. Basal parts of the fixable feet 12*a* are attachable to the side frame 9, and in cross section each foot 12*a* is of an L-shape having its bottom line extending outwards. The tie bar 12*b* is integral with upper inner edges of the feet 12*a*. The clamp fingers 12*c*, which extend from and integral with an edge of the tie bar 12*b*, substantially assume a U-shape as shown in FIG. 4 before receiving and firmly holding the joint pipe. The clamper 12 is a one-piece member which is made from an aluminum brazing sheet by the pressing or the like technique. As for the brazing sheet, it may preferably comprise a core having its both sides clad with a brazing agent layer.

The further clamper 13 for supporting the other joint pipe 6 connected to the outlet of heat exchanging medium comprises likewise a pair of fixable feet 13*a*, a tie bar 13*b* and a clamp finger 13*c*, as shown in FIGS. 1 to 3 and FIG. 5. Each fixable foot 13*a* is of an L-shape having its bottom line extending outwards to be attached to the side frame. The tie bar 13*b* is integral with protruding edges of the feet 13*a*. The clamp finger 13*c*, which extends from and is integral with an upper edge of the tie bar 13*b*, substantially assumes an inverted J-shape as will be seen in FIG. 5 before receiving and firmly holding the joint pipe. Similarly, this clamper 13 also is a one-piece member which is made from an aluminum brazing sheet by the pressing or the like technique. As for the brazing sheet, it may preferably comprise a core having its both sides clad with a brazing agent layer.

In manufacture of the described heat exchanger, its essential parts and accessories are combined at first with one another to form a preassembly.

In detail, the tubes 1 are arranged in parallel with each other and at regular intervals in the direction of their thickness. One of the headers 3 or 4 is located near one ends of the tubes, with the other header 4 or 3 being near to the other ends thereof. All of the tube ends are inserted in respective tube-insertion apertures of the headers. Each corrugated fin 2 is interposed between the two adjacent tubes 1, with further fins being disposed outside the outer most tubes 1, and with the upper side plate 8 being put on the outermost fin 2.

Rivets 14 are used to temporarily set in place, relative to the lower frame 9, the clamper 12 for the inlet joint pipe 5, the further clamper 13 for the outlet joint pipe 6, the lower brackets 10 and other accessories. This side frame 9 is positioned outside the lowermost fin 2.

Basal ends of the joint pipes 5 and 6 are inserted into apertures formed through a periphery of each header 3 and 4, with the intermediate of those joint pipes being accommodated in the respective clamp fingers 12*c* and 13*c* of the clampers 12 and 13. Subsequently, the clamp fingers will be deformed along the periphery of each joint pipe 5 and 6 so as to tightly embrace them in a manner shown in FIGS. 4 and 5. These steps of preliminarily assembling the parts need not be executed in the described order, but may be done in any desired order.

The preassembly of the heat exchanger parts will then be put in a brazing oven where the one-shot brazing of the parts and accessories is carried out using for example a fluoride flux, in order to make them to become firmly integrated.

In detail, the tubes 1, the fins 2, the headers 3 and 4, the upper side plate 8, the lower side frame 9, the inlet joint pipe 5 and the outlet joint pipe 6 will be one-shot brazed to be integral with one another. The lower brackets 10 also are brazed to the headers 3 or 4 and the lower side frame 9.

At the same time, the basal ends of the clampers 12 and 13 will be brazed to the lower side frame 9, with clamp fingers 12*c* and 13*c* also being brazed to the respective joint pipes 5 and 6 during the one-shot brazing.

The clampers 12 and 13 continue to grasp the inlet and outlet joint pipes 5 and 6 until the brazing process is finished. Thus, these joint pipes are prevented from tumbling or rocking by the clampers which act as if they were the jigs during the brazing process. It will be understood that the clamp fingers 12*c* and 13*c* which as a result of the brazing process will become integral with the joint pipes 5 and 6 can continue themselves to function as clamping pieces, without requiring any additional steps or means.

The clamper or clampers of any modified shape or structure different from those in the first embodiment may be employed in the present invention, provided that their clamp fingers are capable of being plastically deformed along or partially around the periphery of each joint pipe.

Although the clampers 12 and 13 are preferably made of the brazing sheet as is the case in the described embodiment, they may be made of an ordinary aluminum sheet if some brazing agent pieces are used to intervene between each joint pipe 5 or 6 and the mating clamp finger 12*c* or 13*c*. Further the one-piece pressed clampers 12 and 13 may be replaced with composite clampers which each comprise some separate parts welded or otherwise adjoined one to another.

The clampers 12 and 13 may not be attached to the side frame 9 of the heat exchanger body, but be fixed on the headers 3 and 4 or on a heat exchanger core composed of the tubes 1 and fins 2. The steps of temporary riveting and subsequent one-shot brazing of the clampers may be replaced with any other suitable steps of processing.

Second Embodiment

In FIGS. 8 to 12, the reference numeral 201 denotes a heat exchanger body, to which attached are: a joint pipe 202 for an inlet of a heat exchanging medium; a further joint pipe 203 for an outlet thereof; and a clamper 204.

The heat exchanger body 201 comprises a plurality of flat tubes 205 arranged parallel and at regular intervals, hollow headers 206 to which both ends of each tube 205 are connected in fluid communication, and a plurality of corrugated fins 207 each interposed between two adjacent tubes 205. Partitions 208 are secured in the headers 206 at given heights so that the heat exchanging medium can successively flow through one and the next groups of the tubes in a meandering manner. The tubes 205 are the so-called harmonica tubes made by extruding aluminum. Each header 206 comprises a cylinder 206*a* having open ends closed with aluminum caps 206*b*. The cylinder 206*a* is made by bending an aluminum brazing sheet to assume a round pipe such that side edges of the sheet abut against one another. A row of tube insertion apertures 206*c* penetrate a peripheral wall of, and extend longitudinally of, the cylinder 206*a*. A round bore 206*d* is also formed through the peripheral wall so as to fit on the joint pipe. Each corrugated fin 207 is an aluminum brazing sheet which is bent in a meandering manner, and louvers 207*a* are opened up through the fin. The partitions 208 also are made of aluminum.

Figure 11:
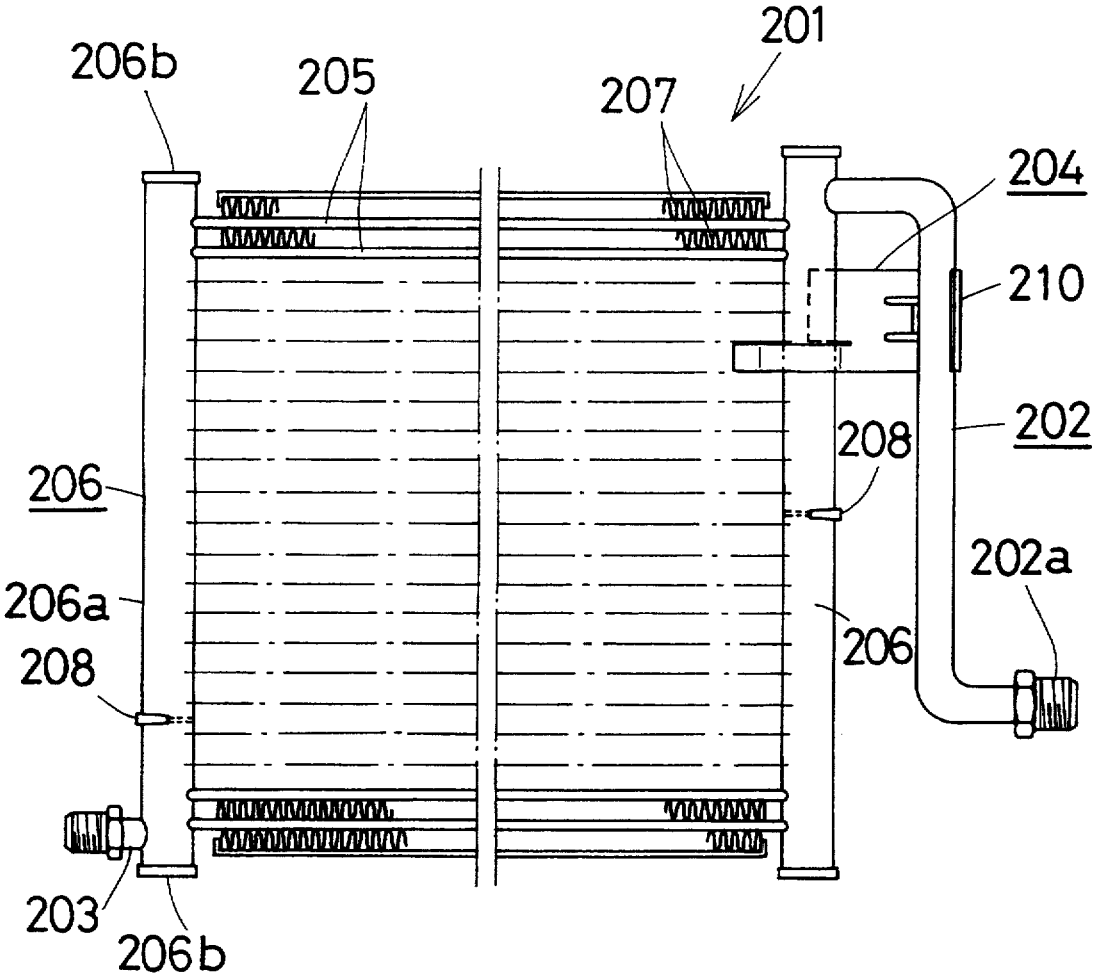
Figure 12:
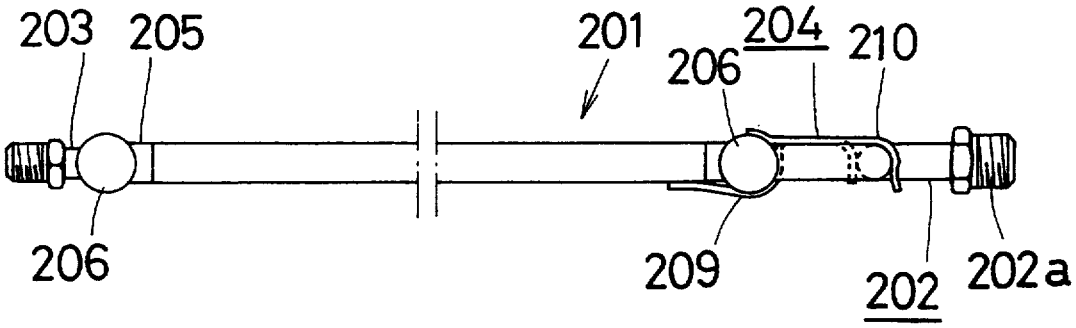

The joint pipe 202 for the heat exchanging medium inlet is made of aluminum and has a tip end 202*a* to be coupled with an external piping. Basal end of this pipe 202 is connected to, and in fluid communication with, an upper peripheral portion of a right-hand header 206 of the heat exchanger body 201, as shown in FIGS. 11 and 12. The joint pipe 202 extends downwardly from the peripheral portion and along the header.

Figure 8:
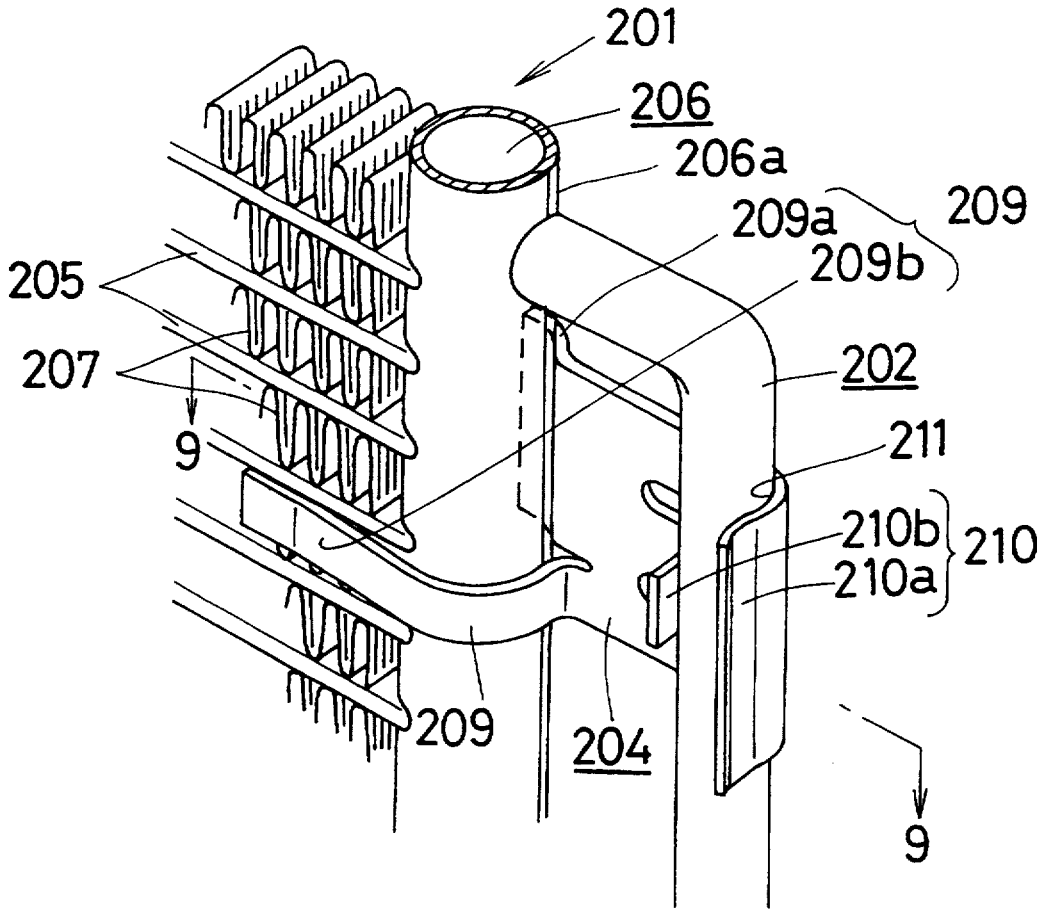

The clamper 204 for gripping the joint pipe 202 at a portion intermediate its longitudinal ends, is a one-piece pressed article of an aluminum brazing sheet. As is shown in FIGS. 8 to 10, this clamper 204 comprises header-embracing fixable feet 209 at one of its ends, and pipe-gripping clamp fingers 210 at the other end to grasp the joint pipe.

One of the fixable feet 209 is an upper foot 209*a*, and the other being a lower foot 209*b* separated from the upper one by a slit which is cut in the one end of the clamper. The upper foot 209*a* extends into behind the heat exchanger body 201, and is fittable on the periphery of the header 206. The lower foot 209*b* extends towards the front face of the body 201, beyond the periphery of said header 206, and protrudes along the front of tubes 205. The fixable feet 209 configurated in this way are suited to embrace the header 206, over its semicircumference.

On the other hand, one of the clamp fingers 210 is an outer clamp finger 210*a*, and the other is an inner clamp finger 210*b*. The outer finger 210*a* is formed arcuate but almost upright relative to the clamper 204, by bending the abovementioned other end thereof. An arcuate region 211 of the outer finger has such a radius of curvature as enabling the finger to fit on the joint pipe 202. The inner clamp finger 210*b* is formed by a U-shaped slot opening through the other end of the clamper. This slot is located inside the outer clamp finger 210*a*, and the clamper's portion encircled with this slot is also bent upright in the same direction as the outer finger so as to stand in parallel therewith.

Figure 9:
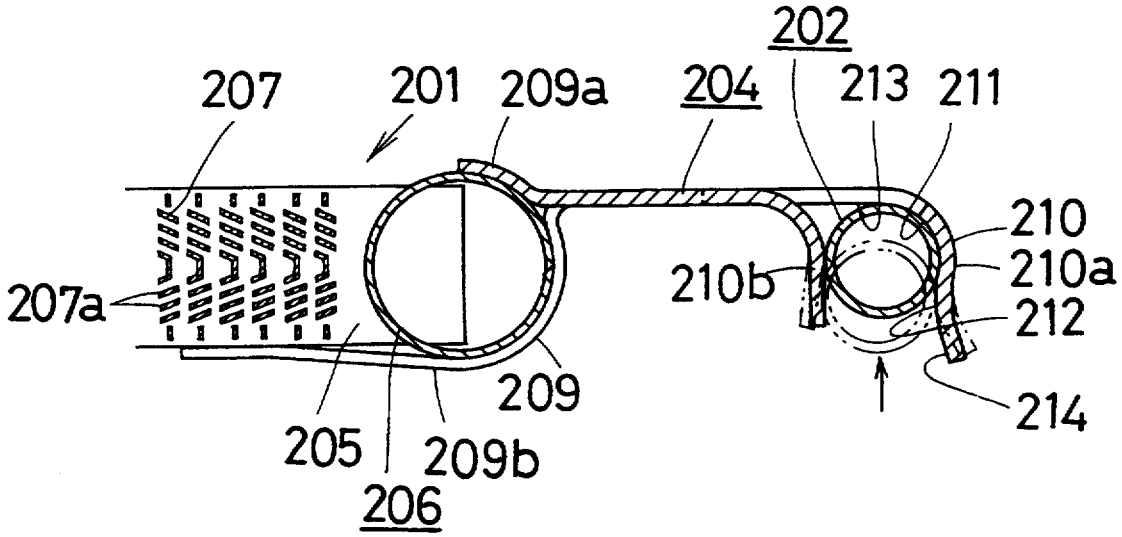
Figure 10:
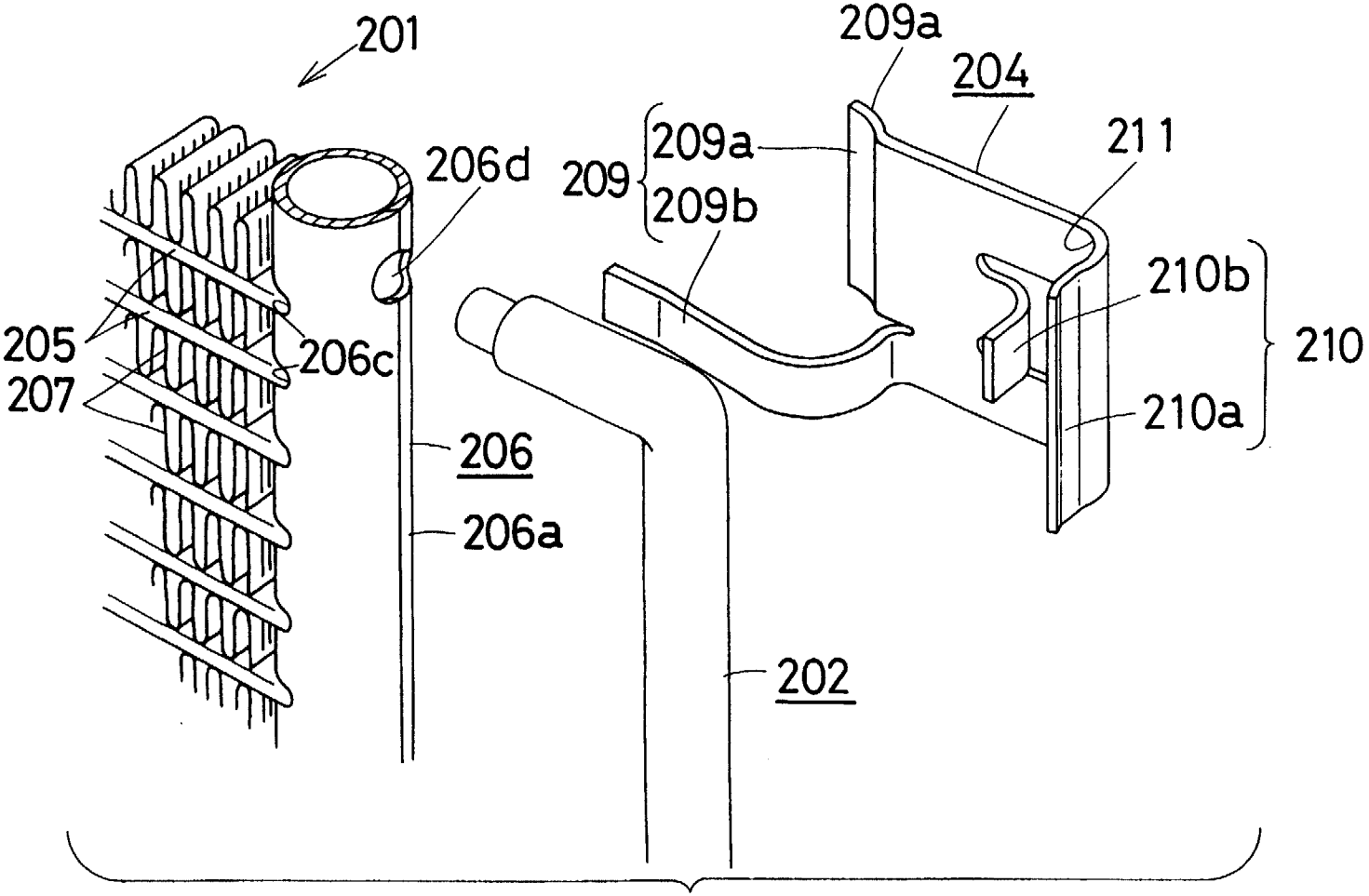

A space between the outer and inner clamp fingers 210*a* and 210*b* is constricted in the middle region 212 as shown in FIG. 9, and the inner expanded part 213 of the space is intended to receive the joint pipe. A front end or lip of the outer finger 210*a* is slightly curved outwardly in front of the constricted region 212, thereby providing a guiding entrance 214 for the joint pipe. Therefore, the joint pipe 202 can be clicked into the inner expanded part 213, through this guiding entrance 214 in the following manner. Namely, the joint pipe 202 placed in said entrance will be urged inwards, to thereby force the outer and inner fingers 210*a* and 210*b* to be elastically deformed outwardly until the pipe 202 slides past the constricted region 212. As this joint pipe 202 further advances deeper towards the expanded part 213, both the clamp fingers 210*a* and 210*b* will elastically recover their unstrained positions so as to inhibit the pipe from slipping off.

Instead of interlocking the joint pipe 202 by means of the detention mechanism just described above, any other structure may be employed in which the elastic recovery in position of the clamp fingers 210*a* and 210*b* is utilized to sandwich the pipe not to be removed.

In manufacture of this heat exchanger, its essential parts and accessories are combined at first with one another to form a preassembly. In detail, the headers 206 are connected to one ends of the parallel flat tubes 205 and to the other ends thereof, by fitting all of those ends in the respective tube-insertion apertures 206*c* to thereby assemble a skeleton of the heat exchanger. Next, each corrugated fin 207 is inserted between two adjacent tubes 205 constituting the skeleton.

The preassembly thus prepared will then be equipped with fittings, that is, the joint pipe 202 for the inlet and the clamper 204. The clamper 204 is attached to the periphery of the joint pipe 202, and whose basal end will be inserted in the round bore 206*d* in the header 206, with the fixable feet 209 being placed on and embracing the header 206.

As for the connection of the clamper 204 and the joint pipe 202, the latter need only be pressed simply in between the outer and inner fingers 210*a* and 210*b* of the clamper 210. The elastic strain and elastic recovery of these fingers during this pushing operation contribute to securely fix the joint pipe 202 on the clamper 204.

Thus, a kind of three-point support is afforded for the joint pipe 202 to be retained in an accurate position on the preassembly, wherein a first support is ensured by the clamper 204 firmly grasping the pipe in the manner just described above, a second support is given by the clamper's fixable feet 209 embracing the header 206 over the semi-circumference thereof, and a third support is provided by the header 206 whose round bore 206*d* receives and fits on the basal end of the joint pipe 202.

Subsequently, the preassembly will be subjected to the so-called one-shot brazing process so that all of its parts and accessories become integral with each other.

Since the curved or arcuate region 211 of the outer finger 210*a* constituting the clamper 204 is an arc of a circle closely fittable on the periphery of the joint pipe 202, the clamper 204 and the pipe 202 are in a broad contact with each other so that they are firmly adjoined in the one-shot brazing process.

Similarly to the finger 204, the fixable feet 209*a* and 209*b* of the clamper 204 are in a wide contact with the periphery of the header 206, whereby they are firmly brazed to the header.

In the thus one-shot brazed heat exchanger, the joint pipe 202 for the medium inlet is fixed in place more tightly and rigidly than in the prior art case of using the bolt-fastened clampers.

In addition to its primary function of holding the joint pipe 202 in place in the completed heat exchanger, the clamper 204 serves also as a jig or tool to maintain a correct position of the pipe 202 in the preassembly before and during the brazing process. Therefore, no other work or labor is required than setting the clamper 204 to hold the unbrazed pipe, in order to ensure a precise brazing of the joint pipe 202 and a permanent and stable clamping thereof after brazed. The joint pipe 202 can now be easily attached to the heat exchanger, without any exceeding labor, whereby the manufacture productivity is remarkably improved.

In more detail, the clamper 204 can readily be connected to the joint pipe 202 simply by pressing the clamp fingers 210 towards the joint pipe, so that it is urged at a touch into a space between the outer and inner fingers 210*a* and 210*b*. The clamper 204 which will have been combined with the pipe 202 in such an efficient manner is brazed to become integral with the pipe in the one-shot brazing process for the preassembled heat exchanger. Thus, such a 'one touch' of the clamper is a sufficient work to permanently build it in the heat exchanger, thereby further improving the efficiency.

Since one of the clamp fingers 210, i.e., the outer finger 210*a* of the clamper 204 is a bent end thereof, this finger including the arcuate region 211 as its basal part can be formed easily, wherein this region is utilized to contact with the joint pipe.

Third Embodiment

Figure 13:
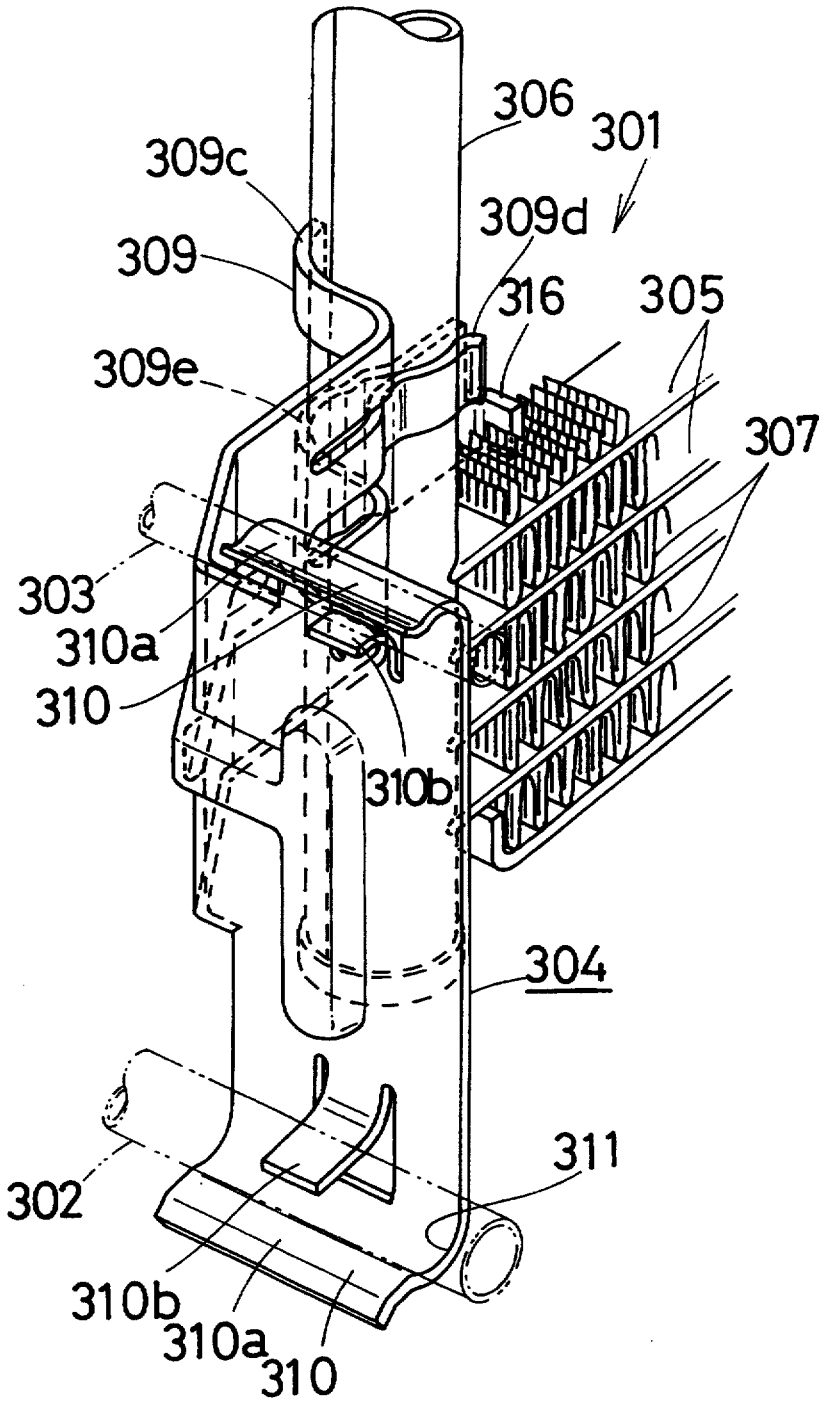
Figure 14:
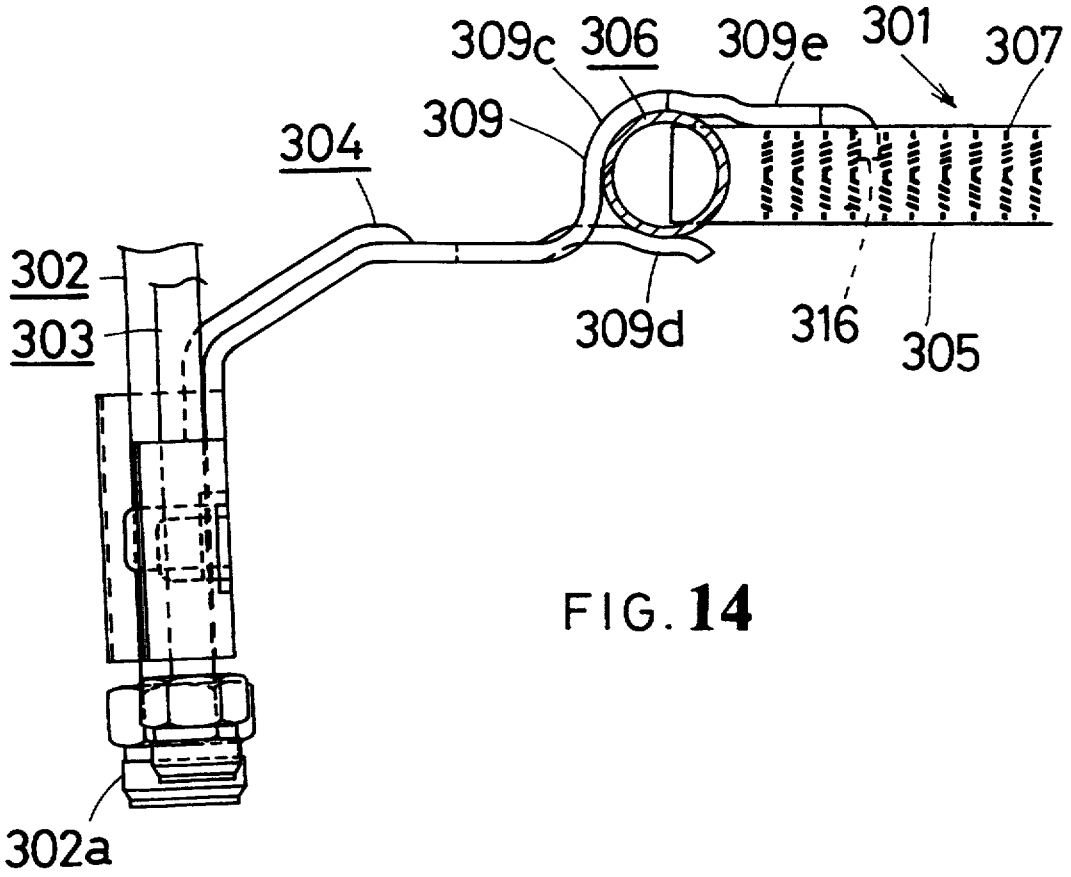
Figure 15:
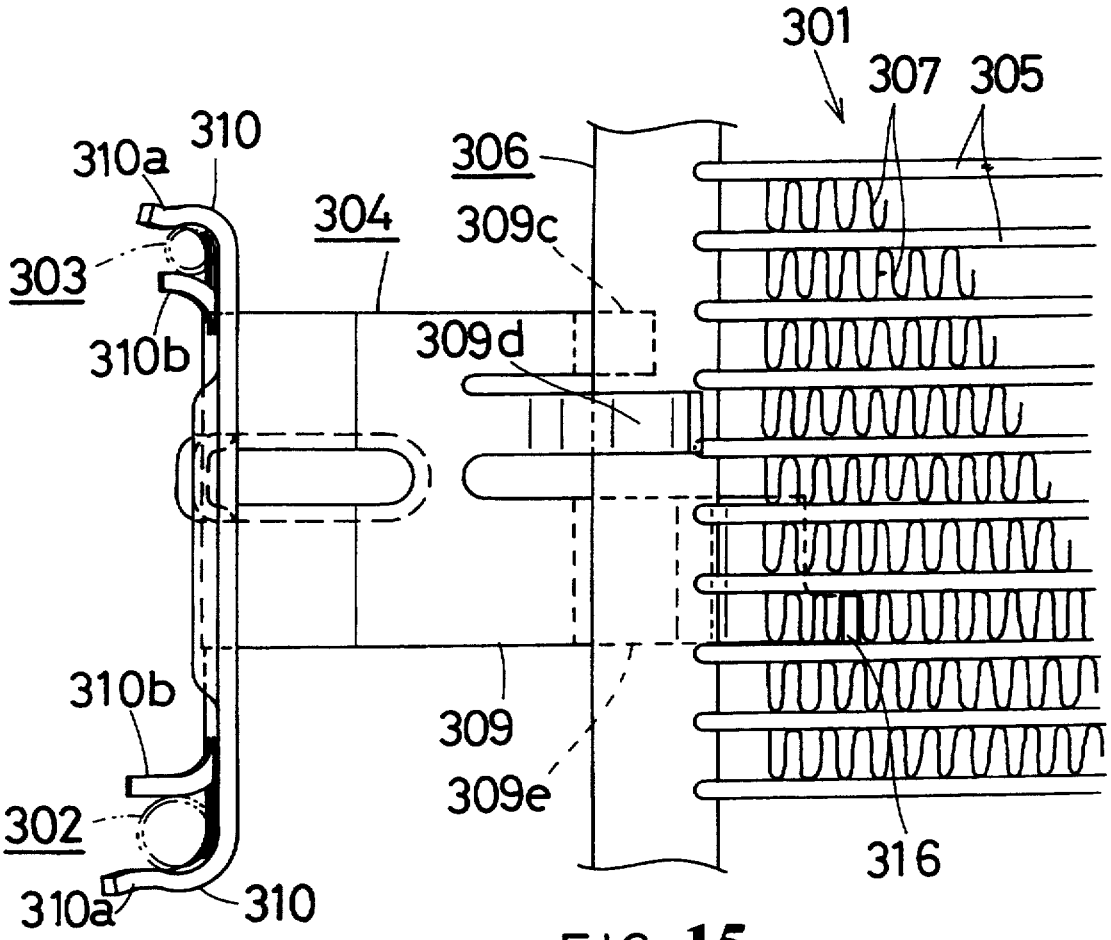

FIGS. 13 to 15 show a third embodiment in which both of two joint pipes 302 and 303 respectively connected to an inlet and outlet of a heat exchanging medium do extend far away from a heat exchanger body 301. Their portions near free ends stand side by side and substantially perpendicular to a header 306. A single clamper 304 is employed herein to support both the joint pipes 302 and 303. The heat exchanger body 301 is the same or similar to that in the preceding embodiments, so that corresponding reference numerals are allotted to corresponding members in order to abbreviate description thereof.

The single clamper 304 is a one-piece pressed article of an aluminum brazing sheet. This clamper 304 comprises header-embracing fixable feet 309 at one of its regions, and two pairs of pipe-gripping clamp fingers 310 and 310 at the other region to grasp the joint pipes.

Two of the three fixable feet 309 are an upper foot 309*c* and a lower foot 309*e*, and the remaining one is a middle foot 309*d* separated from the upper and lower ones by two slits which are cut in the one region of the clamper 304. The upper and lower feet 309*c* and 309*e* extend into behind the heat exchanger body 301, and are fittable on the periphery of the header 306. The middle foot 309*d* extends towards the front face of the body 301, and is fittable on the periphery of the header 306. The fixable feet 309 configurated in this way are suited to embrace the header 306, over its semicircumference, whilst the lower foot 309*e* extends beyond the periphery of said header 306, and protrudes along the front of tubes 305. A tip end of the lower foot 309*e* is of a width substantially equal to a distance between the adjacent tubes 305 and 305, and the tip end is bent towards the heat exchanger body so as to provide a positioning piece 316 which is readily or forcibly fittable in the distance between the tubes. Due to the three or more feet 309*c*, 309*d* and 309*e* as the header-embracing fixable feet 309 of the pressed clamper, it can be secured stable to the header 306, with the piece 316 fittable in between the tubes 305 thereby ensuring a precise positioning of the clamper 304 relative to the header 306.

One pair of clamp fingers 310*a* and 310*b* as well as the other pair 310*a* and 310*b* are formed respectively integral with an upper part and a lower part of the other vertically elongate region of the clamper 304. Their configuration is the same as the pair of pipe-gripping fingers 210 of the clamper 204 in the second embodiment. Thus, both the joint pipes 302 and 303 respectively for the heat exchanging medium inlet and outlet may be held by the respective pairs of clamp fingers 310 of the single clamper 304, in a manner as proposed in this embodiment.

Fourth Embodiment

Figure 16:
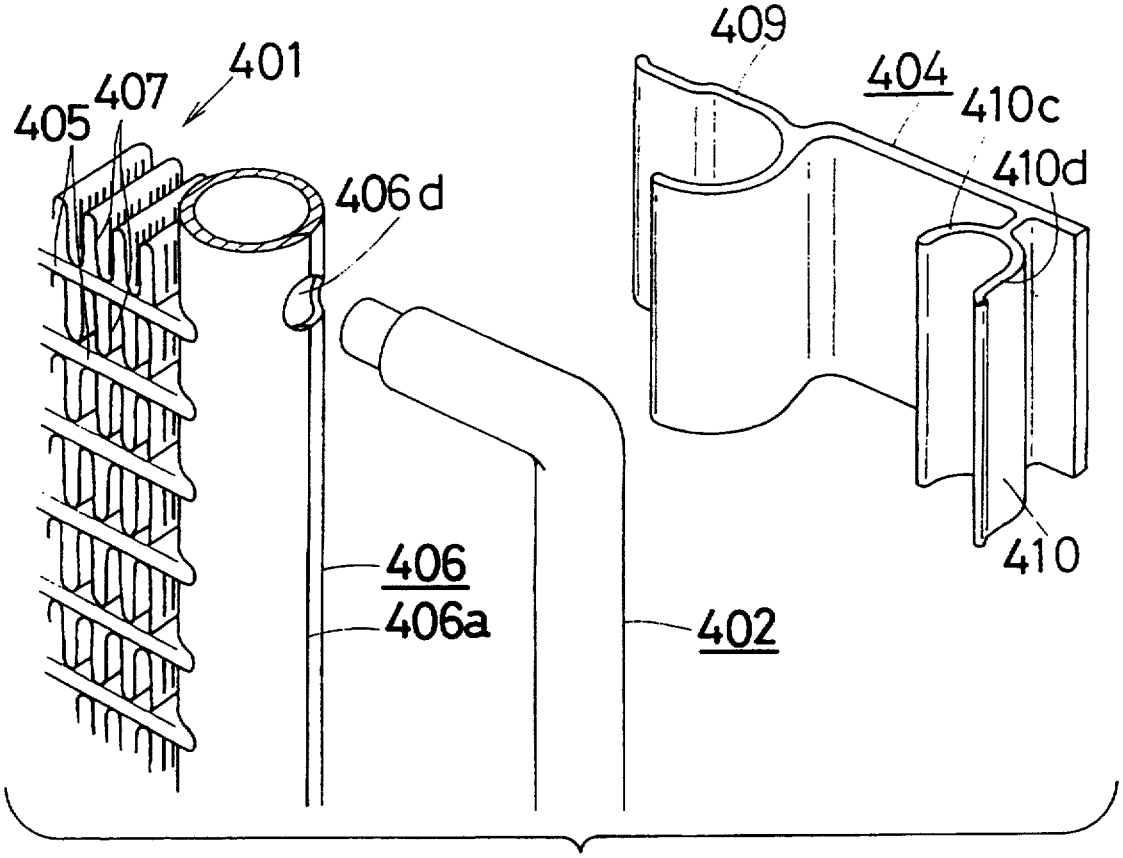
Figure 17:
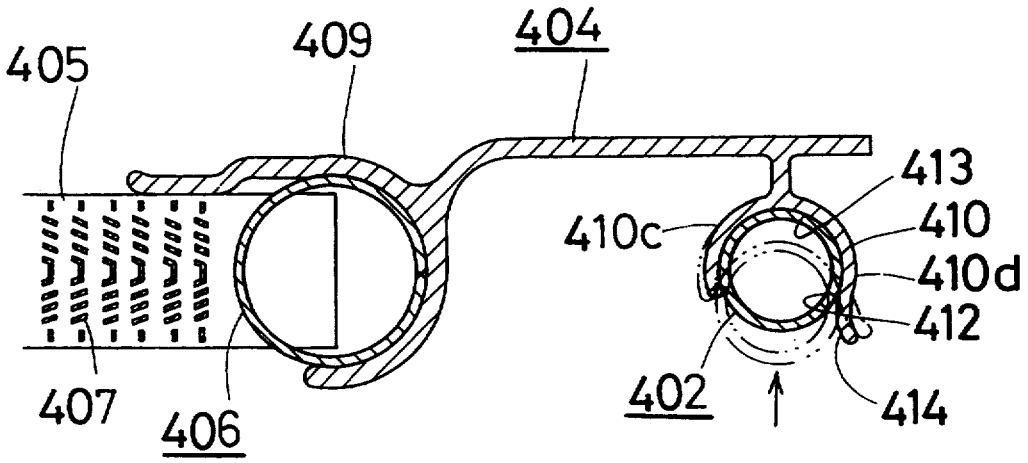

FIGS. 16 to 17 show a fourth embodiment, in which a clamper 404 is an extruded aluminum profile. The heat exchanger body 401 is the same or similar to that in the preceding embodiments, so that corresponding reference numerals are allotted to corresponding members in order to abbreviate description thereof.

Header-embracing fixable feet 409, which are extruded integral with and along one vertical edge of this clamper 404, protrude towards the tubes 405 and are shaped such as to closely fit on the header 406 over its semicircumference. An integral clamp finger adapted to hold the joint pipe 410 and generally C-shaped in cross section is also extruded integral with and along the other vertical edge, and likewise shaped to fit on the joint pipe 402 over its semicircumference.

A space between arcuate walls of the integral clamp finger 410 C-shaped as a whole is constricted in the middle region 412, and the inner expanded part 413 of the space is intended to receive the joint pipe. A front end or lip of one wall 410*c* or 410*d* is slightly curved outwardly in front of the constricted region 412, thereby providing a guiding entrance 414 for the joint pipe. Therefore, the joint pipe 402 can be clicked into and then unremovably held in the space between the walls of the integral finger 410, by virtue of the elastic temporary deformation and elastic recovery of said walls.

The extruded clamper 404 is advantageous over those which are formed by the pressing method, not only in manufacture cost but also in variable desired shape of the clamper.

In order to facilitate the brazing of such an extruded clamper to the joint pipe 402, this pipe may preferably be a seam-welded pipe of an aluminum brazing sheet. If the pipe is an ordinary aluminum pipe, then solid pieces of a brazing agent may be put in between the contact surfaces of those clamper and pipe.

Since the clamper 404 comprises the elastically deformable integral clamp finger 410, the joint pipe 402 can engage with them at 'one touch' and thereafter be held in place by the clamper 404 stably in the preassembly. Therefore, efficiency of the work for combining the pipe with the clamper, and as a result, productivity of the manufacture of heat exchangers, are improved.

Fifth Embodiment

In a heat exchanger shown in FIGS. 25 to 28, the reference numeral 501 denotes a heat exchanger body, and the numeral 502 denotes a pipe-and-clamper unit.

The heat exchanger body 501 comprises, similarly to those in the preceding embodiments, a plurality of flat tubes 505 arranged parallel and at regular intervals, hollow headers 506 to which both ends of each tube 505 are connected in fluid communication, and a plurality of corrugated fins 507 each interposed between two adjacent tubes 505. Partitions 508 are secured in the headers 506 at given heights so that the heal exchanging medium can successively flow through one and the next groups of the tubes in a meandering manner. The tubes 505 are the so-called harmonica tubes made by extruding aluminum. Each header 506 comprises a cylinder 506*a* having open ends closed with aluminum caps 506*b*. The cylinder 506*a* is made by bending an aluminum brazing sheet to assume a round pipe such that side edges of the sheet abut against one another. A row of tube insertion apertures 506*c* penetrate a peripheral wall of, and extend longitudinally of, the cylinder 506*a*. A round bore 506*d* is also formed through the peripheral wall so as to fit on the joint pipe. Each corrugated fin 507 is an aluminum brazing sheet which is bent in a meandering manner, and louvers are opened up through the fin. The partitions 508 also are made of aluminum.

The pipe-and-clamper unit 502 is composed of a joint pipe 509 for an inlet of a heat exchanger medium, a further joint pipe 510 for an outlet of the medium, and clamper 511.

Figure 26:
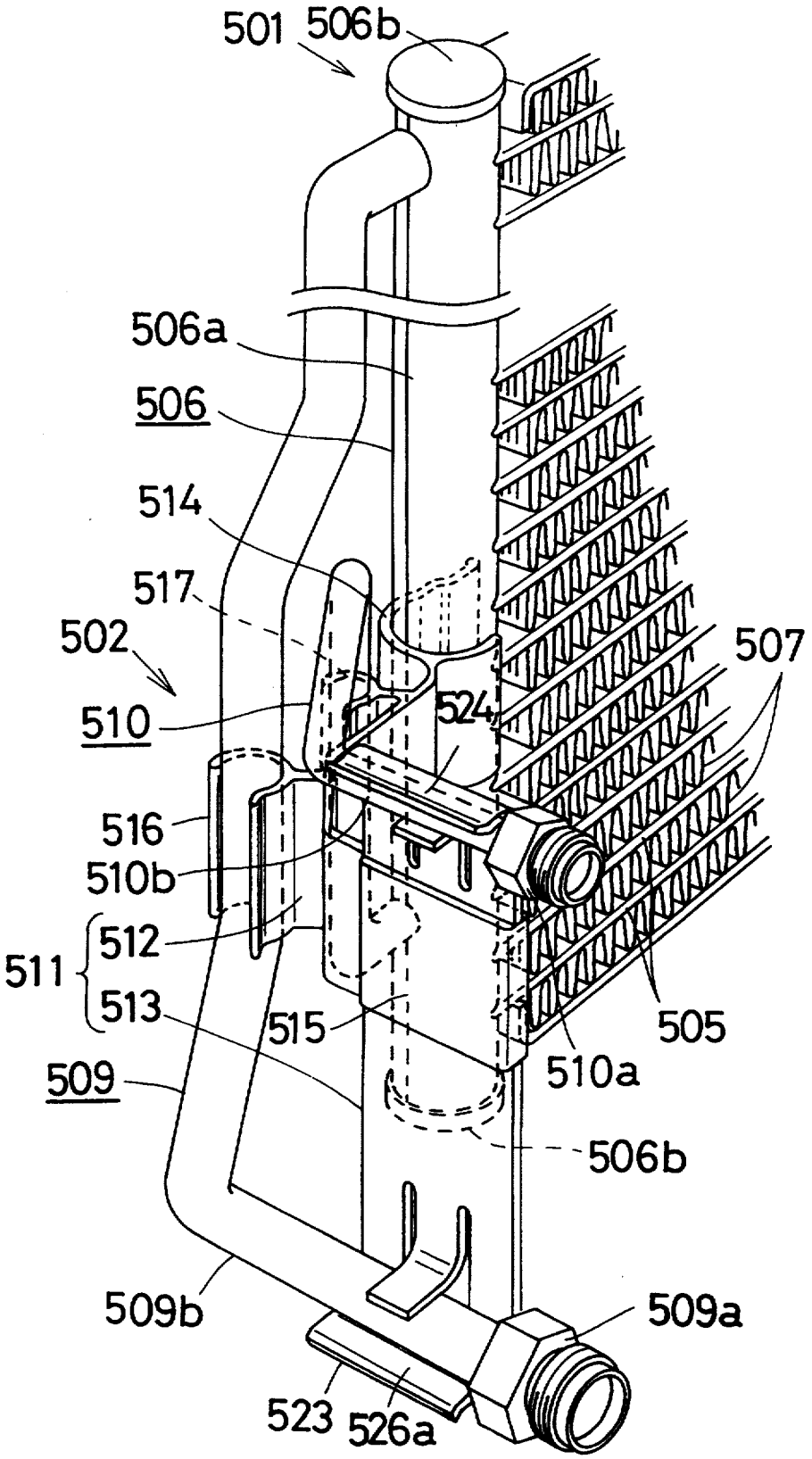
Figure 27:
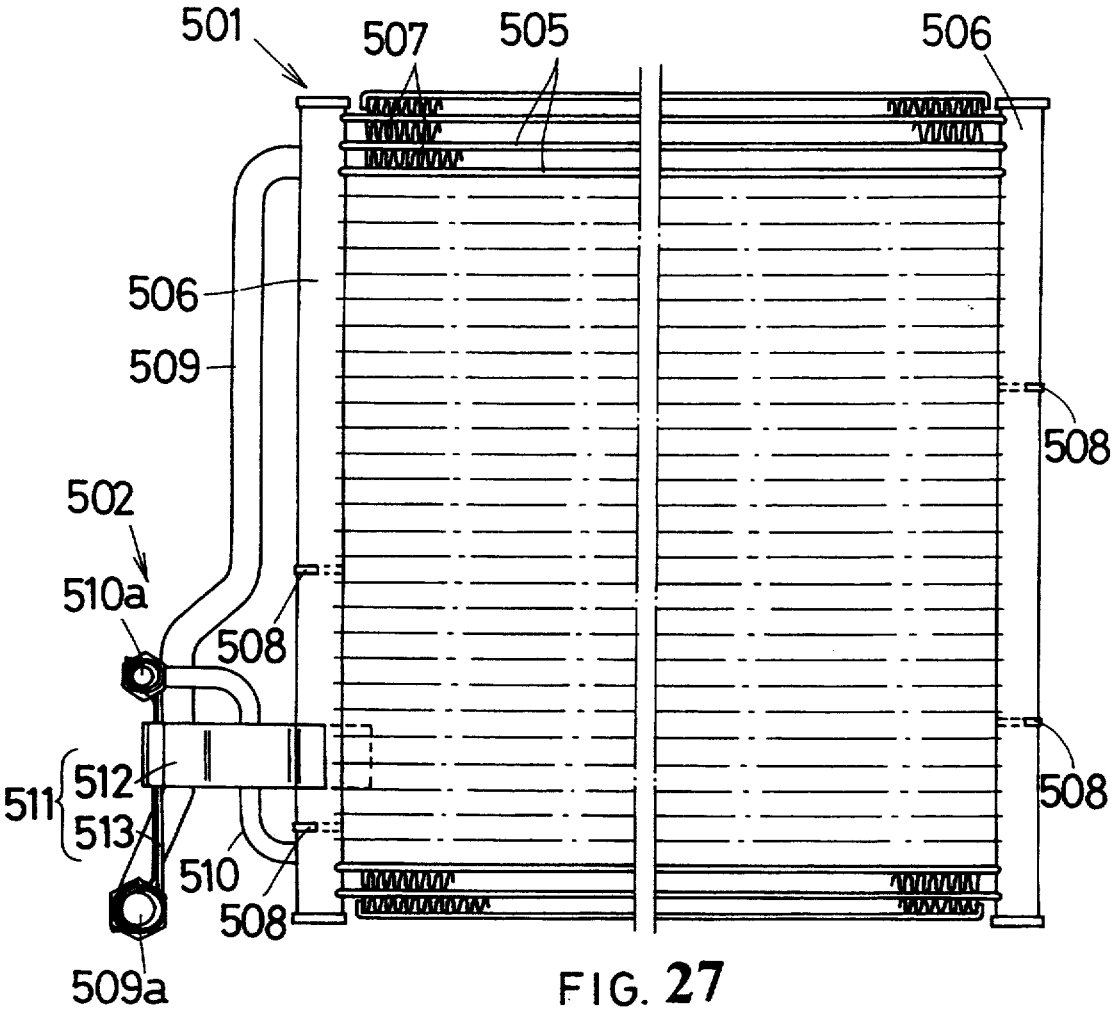
Figure 28:
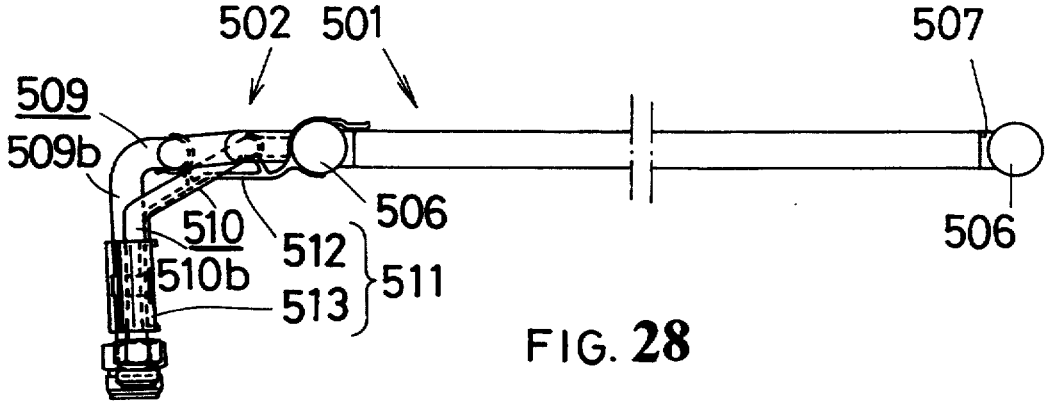
Figure 29:
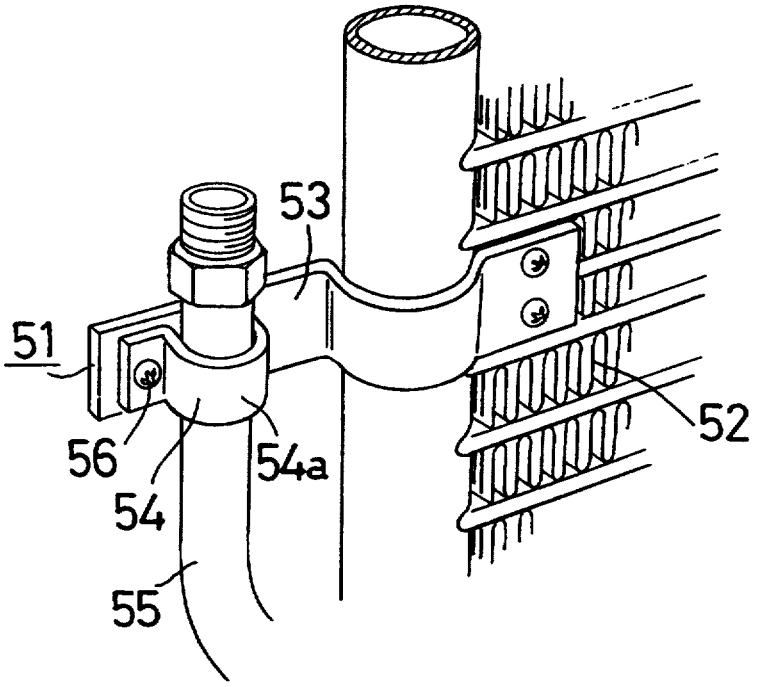
FIG. 29 (PRIOR ART)
FIG. 29 is a perspective view of a heat exchanger shown in part and having a prior art clamper attached thereto.

The joint pipe 509 for the inlet is an aluminum pipe which has at one of its ends a connector 509*a* for an external piping. As is shown in FIGS. 26 to 28, the other or basal end of the joint pipe 509 is connected to a top peripheral portion of the left-hand header 506. This pipe descends from said top portion along the header 506, until bent at bottom so as to further extend forwardly of the heat exchanger body. This forward and horizontal extension 509*b* lies not in parallel with but perpendicular to the header 506.

The further joint pipe 510 for the outlet is also an aluminum pipe which has at one of its ends a connector 510*a* for another external piping. The other or basal end of the joint pipe 510 is connected to a bottom peripheral portion of the left-hand header 506. This pipe ascends from said bottom portion along the header 506, until bent outwards and then bent forwards so as to further extend forwardly of the heat exchanger body. This forward and horizontal extension 510*b* also lies not in parallel with but perpendicular to the header 506, so that two horizontal extensions 509*b* and 510*b* stand side by side in an assembly.

Figure 18:
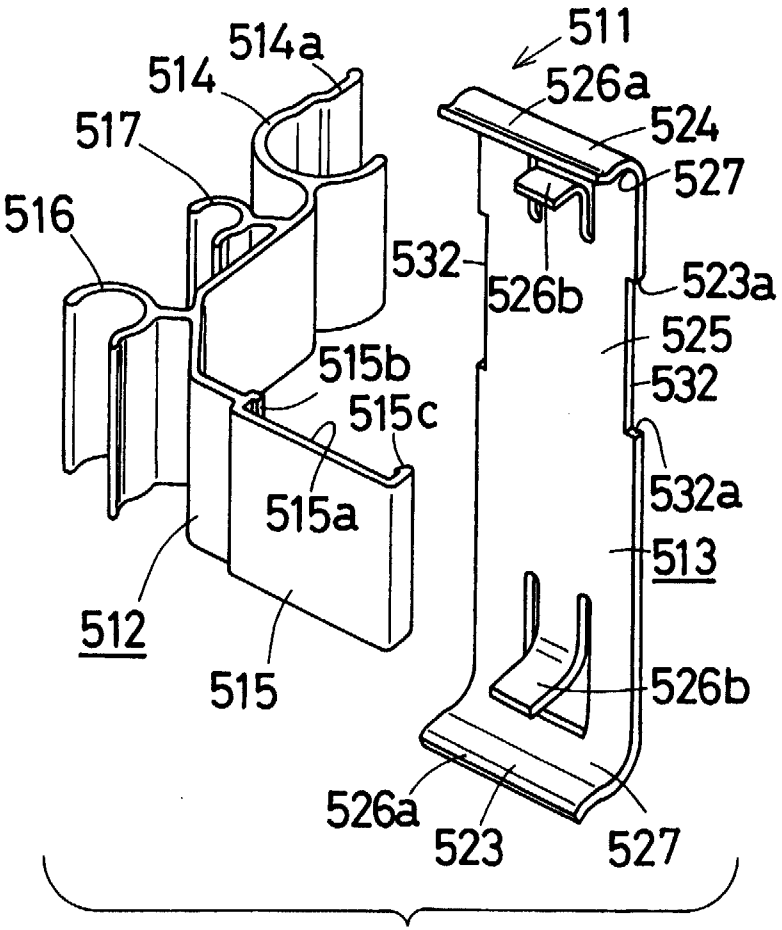

The clamper 511 in this embodiment is composed of a first and second segments 512 and 513, as illustrated in FIGS. 18.

The first segment 512, which is to be brazed to the header 506, is a one-piece extruded aluminum member generally L-shaped in cross section. As shown in FIGS. 18 to 21B, header-embracing fixable feet 514 are formed integral with one end of the first segment, and a flat connectable portion 515 is formed integral with the other end of this segment. The flat connectable portion 515 of the first segment is engageable with the second segment 513. The first segment's middle region intermediate its opposite ends is formed with two integral clamp fingers 516 and 517 each composed of arcuate walls adapted to clamp the joint pipe 509 or 510.

Figure 20A:
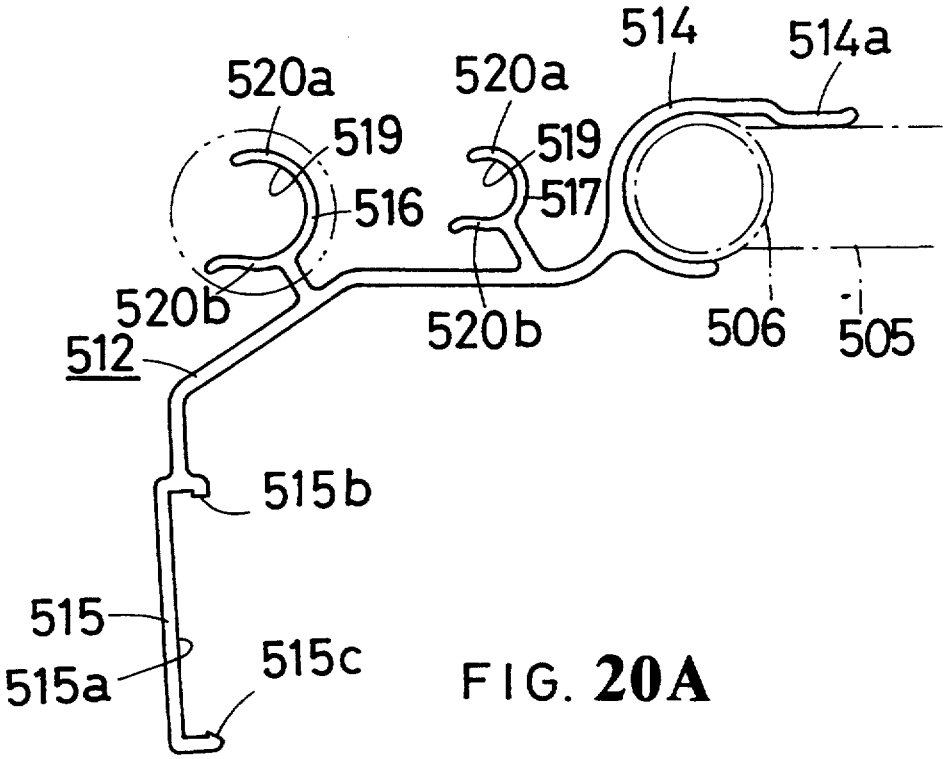
FIG. 20A is a plan view of the first segment of the clamper.

The fixable feet 514 consist of two feet which cooperate with one another to tightly embrace the header 506, over its semicircumference as shown in FIG. 20A. One of the feet is formed with a protrusion 514*a* which abut against side edges of the adjacent tubes 505. This protrusion enables the first segment 512 to be set in a correct angular position relative to the header 506.

FIG. 20A and FIGS. 22 to 24 show in detail the flat connectable portion 515 which is formed to have a shallow and broad recess 515*a*. This recess 515*a* for receiving the second segment 513 is defined between two low walls opposite to each other, wherein one wall has at its top a small retaining lug 515*b* protruding inwards, and the other wall also has at its top a detent lug 515*c*. The detent lug 515*c* is triangular in cross section and also protruding inwards.

Figure 20B:
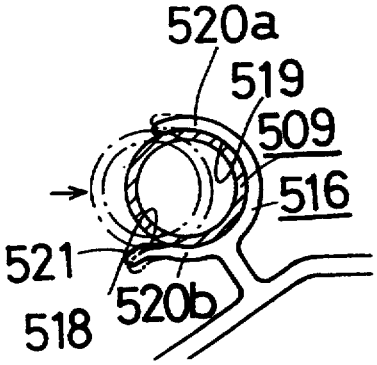
FIG. 20B is a plan view showing in part the first segment together with a joint pipe which is fitted in the segment's region encircled with a double-dotted phantom line in FIG. 20A.

Each of the integral clamp fingers 516 and 517, which have to retain vertical bodies 509*c* and 510*c* of the joint pipes, respectively, are C-shaped in cross section as shown in FIGS. 20A and 20B. The C-shaped integral fingers 516 and 517 can embrace the joint pipes 509 and 510 over their semicircumferences. A space between the arcuate walls 520*a* and 520*b* of each integral clamp finger is constricted in the middle region 518, and the inner expanded part 519 of the space is intended to receive the joint pipe. A front end or lip of one wall 520*a* or 520*b* is slightly curved outwardly in front of the constricted region, thereby providing a guiding entrance 521 for the joint pipe. Therefore the joint pipe, for instance 509, can be clicked past the constricted region 518 into the inner expanded part 519, through this guiding entrance 521 in the following manner. Namely, the joint pipe 509 placed in said entrance will be urged inwards, to thereby force the clamp finger walls 520*a* and 520*b* to be elastically deformed outwardly until the pipe 509 slides past the constructed region 518. As this joint pipe 509 further advances deeper towards the expanded part 519, both the clamp finger walls 520*a* and 520*b* will elastically recover their unstrained positions where they are in surface contact with the pipe 509 and inhibit it from slipping off in the preassembly.

The second segment 513 of the camper 511 is a pressed article of an aluminum brazing sheet, and is generally rectangular in its entirety as shown in FIG. 18. A pair of pipe-holding clamp fingers 523 are formed integral with a longitudinal end of this segment 513, in order to receive the horizontal extension 509*b* of the joint pipe 509 for inlet, whilst another pair of clamp fingers 524 are formed integral with another longitudinal end of this segment 513, in order to receive the horizontal extension 510*b* of the other joint pipe 510 for outlet. A flat constricted region 525 is present intermediate the ends of the second segment 513, with the region 525 being engageable with the first segment 512.

Figure 19:
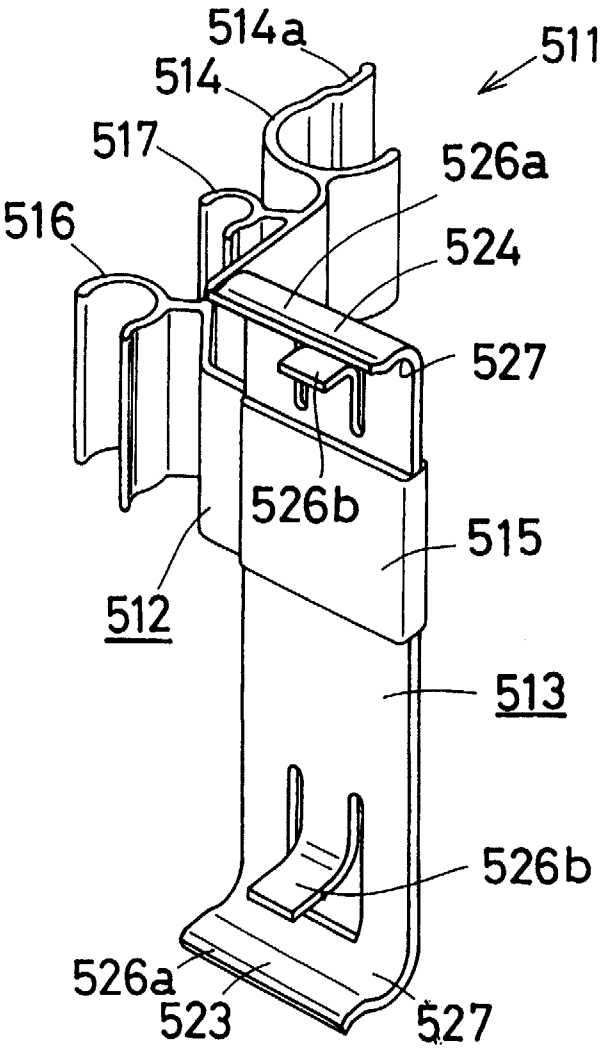

As is shown in FIGS. 18 and 19, one pair of the clamp fingers 523 is of the same structure as the other pair of fingers 524, both for receiving the joint pipes. Each pair comprises an outer upright finger 526*a* and an inner upright finger 526*b*. The outer finger 526*a* is formed arcuate but almost upright relative to the segment 513, by bending the abovementioned one end thereof. An arcuate region 527 of the outer finger assumes an arc of a circle fittable on the joint pipe 509 or 510. The inner finger 526*b* is formed by a U-shaped slot opening through the other end of the segment. This slot is located inside the outer finger 526*a*, and the segment's portion encircled with this slot is also bent upright in the same direction as the outer finger so as to provide the inner finger 526*b* standing in parallel with the outer finger.

Figure 21A:
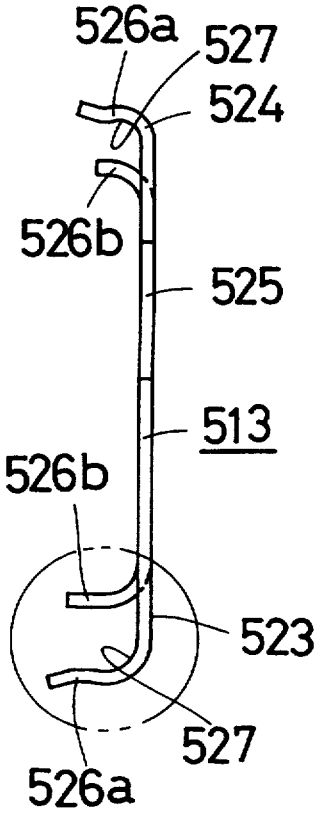
FIG. 21A is a plan view of the second segment of the clamper.
Figure 21B:
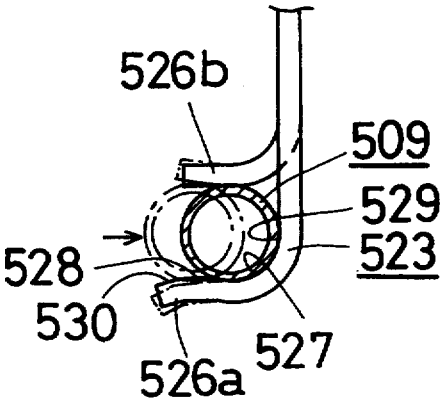
FIG. 21B is a plan view showing in part the second segment together with another joint pipe which is fitted in the segment's region encircled with a double-dotted phantom Line in FIG. 21A.

A space between the outer and inner clamp fingers 526*a* and 526*b* is constricted in the middle region 528 as shown in FIGS. 21A and 21B, and the inner expanded part 529 of the space is intended to receive the joint pipe. A front end or lip of the outer finger 526*a* is slightly curved outwardly in front of the constricted region 528, thereby providing a guiding entrance 530 for the joint pipe. Therefore the joint pipe, for instance 509 can be clicked into the inner expanded part 529, through this guiding entrance 530 in the following manner. Namely, the joint pipe 509 placed in said entrance will be urged inwards, to thereby force the outer and inner fingers 526*a* and 526*b* to be elastically deformed outwardly until the pipe 509 slides past the constricted region 528. As this joint pipe 509 further advances deeper towards the expanded part 529, both the clamp fingers 526*a* and 526*b* will elastically recover their unstrained positions where they are in surface contact with the pipe and inhibit it from slipping off.

Instead of interlocking the joint pipes 509 and 510 by means of the detent mechanism just described above, any other structure may be employed in which the elastic recovery in position of the clamp fingers 526*a* and 526*b* is utilized to sandwich the pipe not to be removed.

The flat constricted region 525 shown in FIG. 18 is defined between two cutouts 532, which are formed along the lateral edges in the intermediate region of the second segment 513. The vertical length of each cutout 532 is equal to the height of the first segment 512. Due to those cutouts 532, the horizontal width of the constricted region 525 corresponds to that of the shallow recess 515*a* of the connectable portion 515. Shoulders 532*a* at opposite ends of each cutout 532 regulate the vertical position of the second segment relative to the first one.

The pipe-and-clamper unit may be assembled in the following manner. At first, the first segment 512 will be combined with the second one 513 by fitting the connectable portion 515 of the former on the constricted region 525 of the latter. Then, the vertical bodies of 509*c* and 510*c* of the joint pipes 509 and 510 will be brought into engagement with the C-shaped integral clamp fingers 516 and 517 of the first segment 512, while putting the horizontal extensions 509*d* and 510*d* into the pairs of clamp fingers 523 and 524 of the second segment 513, respectively.

Figure 22:
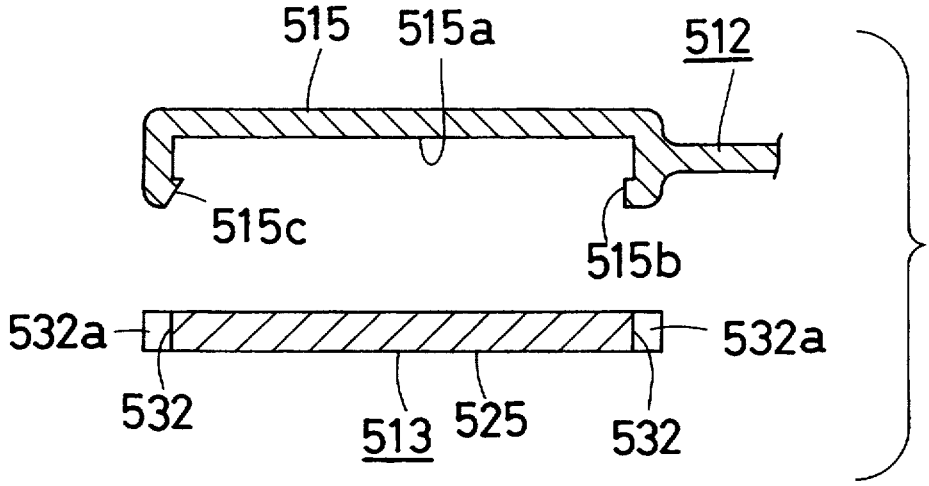
Figure 23:
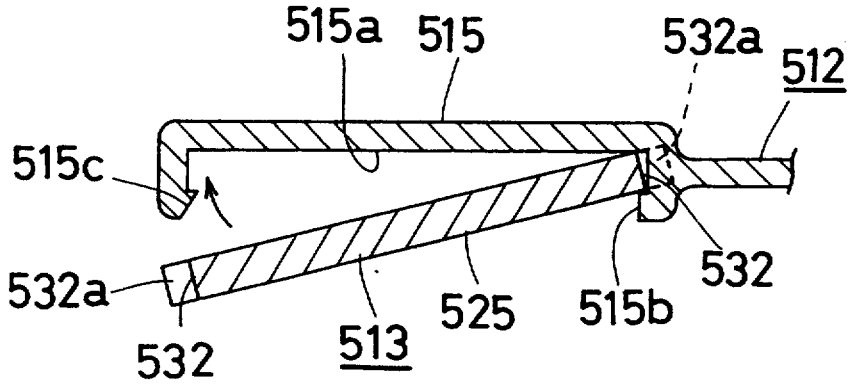
Figure 24:
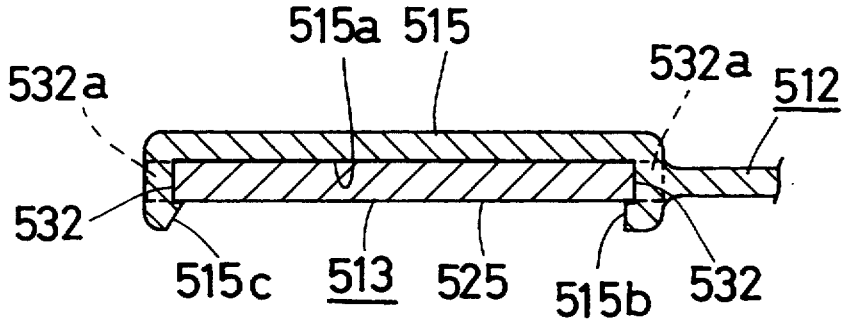
Figure 25:
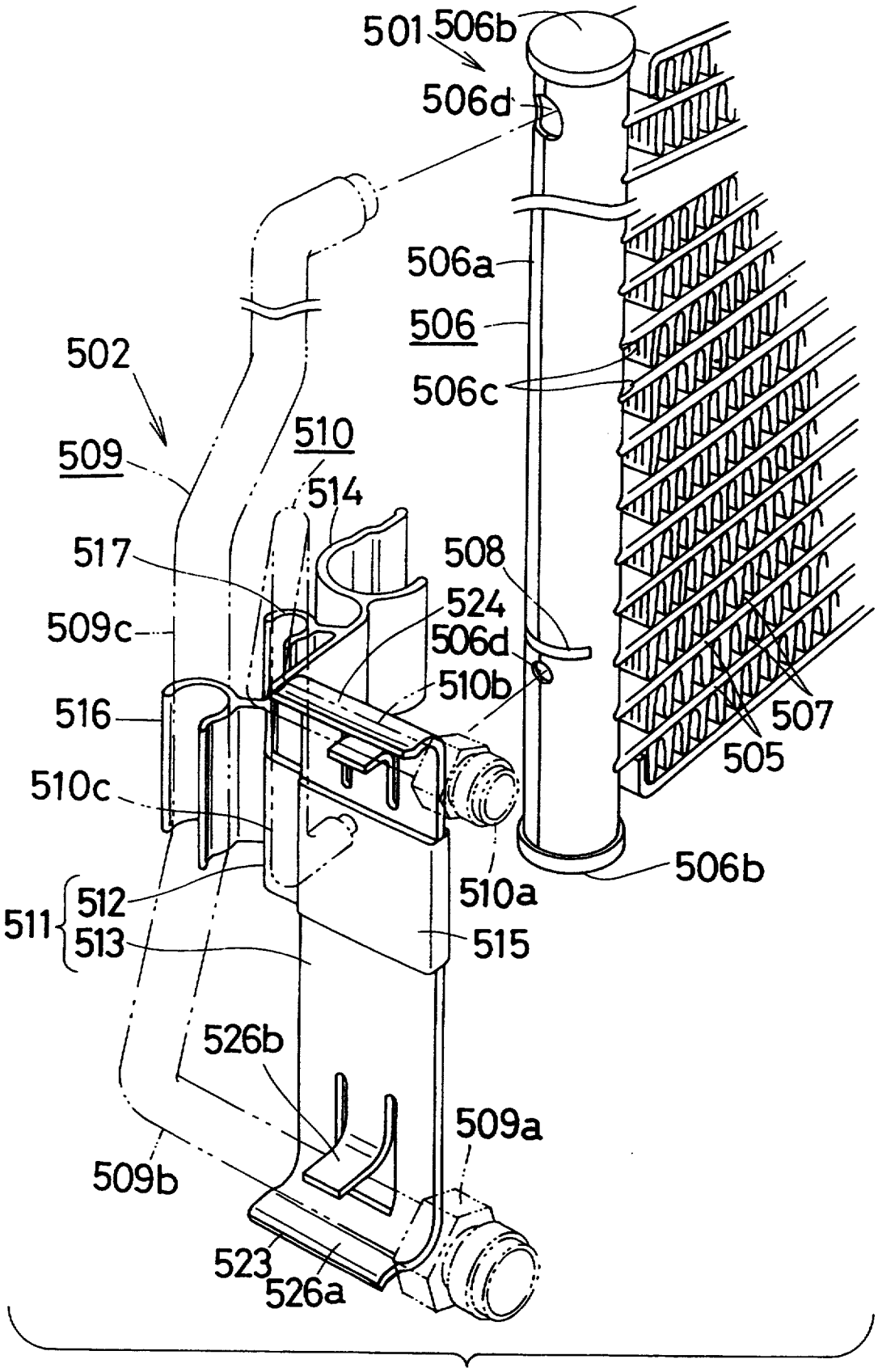

The abovementioned coupling of the connectable portion 515 with the constricted region 525 will be carried out in a manner shown in FIGS. 22 to 24. One lateral edge of the second segment's region 525 will be put into the first segment's shallow recess and under its small retaining lug 515*b* of connectable portion 515. Subsequently, the other lateral side of the second segment's constricted region 525 will be rotatingly pushed towards the shallow recess until it clicks over the detent lug 515*c* so that this region 525 is entirely received in the first segment's connectable portion 515. In this state, the shoulders 532*a* defining the second segment's cutouts do grip said portion 515 of the first segment at its upper and lower edges, whereby the two segments 512 and 513 are firmly combined with one another without fear of unintentional disconnection or relative displacement.

It will now be apparent that the pipe-and-clamper unit 502 can be assembled efficiently, because the first and second segments 512 and 513 are combined with one another in the described simple manner and the joint pipes 509 and 510 are merely pushed into engagement with the respective pairs of clamp fingers which the clamper segments 512 and 513 comprise.

In manufacture of this heat exchanger, its essential parts and accessories are combined at first with one another to form a preassembly. In detail, the headers 506 are connected to one ends of the parallel flat tubes 505 and to the other ends thereof, by fitting all of those ends in the respective tube-insertion apertures 506*c* to thereby assemble a skeleton of the heat exchanger. Next, each corrugated fin 507 is inserted between two adjacent tubes 505 constituting the skeleton.

The preassembled heat exchanger body 501 will then be equipped with fittings, that is, the pipe-and-clamper unit 502. Basal ends of the joint pipes 509 and 510 carried by the unit 502 will be inserted in the respective round bores 506*d* in the header 506, with the fixable feet 514 of the first clamper segment 512 being placed on and embracing the header 506. Already in this state, both the joint pipes 509 and 510 are preliminarily attached by the clamper 511 to the heat exchanger body 501 to provide a preassembly. Since the header-embracing feet 514 grasp the header 506 over its semcircumference, and in addition, since the basal ends of the joint pipes 509 and 510 are firmly retained in the round bores 506*d* of the header, the preassembled heat exchanger body 501 can now hold this unit 502 not shaky but stable, without needing any additional means.

Subsequently, the preassembly will be subjected to the so-called one-shot brazing process so that all of its parts and accessories become integral with each other. Since the curved or arcuate region 527 of each outer finger 526*a* constituting the pairs of clamper fingers 523 and 524 in the second clamper segment 513 is an arc of circle closely fittable on the periphery of each corresponding joint pipe 509 or 510, the pairs of clamp fingers 523 and 524 and the pipes 509 and 510 are respectively in a broad contact with each other so that they are firmly adjoined in the one-shot brazing process. Similarly to the clamp fingers, the fixable feet 514 of the first clamper segment 512 are in a wide contact with the periphery of the header 506, whereby they are firmly brazed to this header. Further, the large areas of the connectable portion 515 and the constricted region 525 are effective to firmly braze the first segment 512 of the clamper to the second one 513. In the thus one-shot brazed heat exchanger, the joint pipes 509 and 510 for the medium inlet and outlet are fixed in place on the heat exchanger body 501 more tightly and more rigidly than in the prior art case of using the bolt-fastened clampers. It is also noted that since the header 506 is the cylinder 506*a* made of the brazing sheet, the first clamper segment 512 will be brazed to the header simultaneously with the brazing of the abutting vertical edges of said cylinder. However, the segment may alternatively be brazed to the header by using a brazing agent piece put in between them. Further, the joint pipes 509 and 510 may be seam-welded pipes made of an aluminum brazing sheet for the purpose of facilitating their brazing to the first clamper segment 512, or instead, the brazing agent piece may be used between them.

In addition to its primary function of holding the joint pipes 509 and 510 in place in the completed heat exchanger, the clamper 511 serves also as a jig or tool to maintain each of the joint pipes at its correct position in the preassembly before and during the brazing process. Therefore, no other work or labor is required than setting the clamper 511 to hold the unbrazed pipes, in order to ensure a precise brazing of the joint pipes 509 and 510 and a permanent and stable clamping thereof after brazed. The joint pipes can now be easily attached to the heat exchanger, without any exceeding labor, whereby the manufacture productivity is remarkably raised. Besides, since both the joint pipes 509 and 510 are preliminarily combined with the first and second clamper segments to form the unit, prior to incorporation of them into the preassembly, not only the assembling of said unit itself but also the attaching of those segments 512 and 513 and those pipes 509 and 510 are simplified to further improve the productivity of the heat exchangers of this type.

Furthermore, since the clamper 511 consists of the first and second segments 512 and 513 wherein the first one 512 for gripping the header 506 is an extruded article and the second one 513 for gripping the horizontal extensions 509*b* and 510*b* of joint pipes 509 and 510 is a pressed article, those segments can not only be prepared easily to render advantageous in manufacture cost of the clamper 511, but also reduces to a significant extent the manufacture cost of the heat exchanger as a whole.

A still another advantages is that since one of upright clamp fingers 526*a* and 526*b*, for example the outer one in each pair thereof in the second segment 513 is a bent end thereof, this finger including its arcuate region 527 can be formed easily, wherein this region contacts with and brazed to the joint pipe.

What is claimed is:

1. A heat exchanger comprising:
an inlet of a heat exchanging medium;
an outlet of the heat exchanging medium;
a heat exchanger body formed with the outlet and the inlet and conducting the exchange of heat between the medium flowing through the body and an ambient air, with the heat exchanger body being composed of essential parts which include:
a pair of headers spaced a predetermined distance from one another and arranged in parallel with each other;
each header having a row of slits formed at regular intervals;
a plurality of tubes arranged in parallel with one another and each having its both ends liquid-tightly connected and brazed to the respective slits; and
fins each interposed between the adjacent tubes and integrally brazed thereto, the heat exchanger further comprising:
at least one joint pipe connected to the inlet and/or outlet and allowing the medium to flow into or out of the heat exchanger body;
a frame to which at least one clamper is attached;
the clamper being designed to temporarily hold in place the joint pipe on the heat exchanger body when a temporary assembly of the essential parts are brazed integral with one another, with the clamper being also constructed such as to fixedly secure the joint pipe to the heat exchanger body once the essential parts are brazed, and the clamper comprising:
at least one pair of the clamp fingers facing one another and spaced a distance from each other so that the clamp fingers are fittable sideways on the joint pipe, wherein the clamper having fixable feet secured to the frame, and the joint pipe is held by and brazed to the clamp fingers so as to be integral therewith.

2. A method of making a heat exchanger which comprises a heat exchanger body having an inlet and an outlet for a heat exchanging medium, wherein the heat exchanger body comprises as its parts: a pair of headers spaced a predetermined distance from one another and arranged in parallel with each other; a plurality of flat tubes which are arranged in parallel with one another and each having its both ends inserted in slits which are formed in the headers so that the both ends of each tubes are liquid-tightly brazeable thereto; fins each interposed between the adjacent tubes and brazeable thereto to be integral therewith; and at least one joint pipe having ends brazeable integrally to the inlet or outlet which is formed in the header, the method comprising the steps of:
preparing at least one clamper which is made of a brazing sheet and comprises: fixable feet for attaching the clamper to the heat exchanger body; and at least one clamp finger fittable on the joint pipe;
preliminarily assembling the parts to form a preassembly;
connecting an end of the point pipe to the header in fluid communication therewith;

attaching an accessory to the temporary assembly;

attaching to the accessory the fixable feet by using a temporary setting means;

temporarily setting a portion of the joint pipe in between and holding the joint pipe by the clamp fingers; and brazing the parts one to another whereby the clamp fingers are brazed at the same time to the joint pipe and also the fixable feet are brazed at the same time to the accessory.

3. The method as defined in claim 2, wherein the clamper is made of a brazing sheet, and comprises only one integral clamp finger.

4. The method as defined in claim 3, wherein the integral clamp finger is J- or U-shaped so as to accommodate therein the joint pipe.

5. The method as defined in any of the preceding claims 2, 3 or 4, wherein the clamper is a one-piece molded article made of a brazing sheet which is composed of a core having its one or both sides clad with a brazing agent layer.

6. The method as defined in claim 2, wherein the clamper is made of a brazing sheet and comprises a pair of the clamp fingers facing one another.

* * * * *